US011040458B2

(12) United States Patent
Krenik

(10) Patent No.: US 11,040,458 B2
(45) Date of Patent: Jun. 22, 2021

(54) HAIR CUTTING DEVICE FOR AUTOMATED HAIR CUTTING SYSTEM

(71) Applicant: Matthew W. Krenik, Garland, TX (US)

(72) Inventor: Matthew W. Krenik, Garland, TX (US)

( * ) Notice: Subject to any disclaimer, the term of this patent is extended or adjusted under 35 U.S.C. 154(b) by 91 days.

(21) Appl. No.: 14/143,469

(22) Filed: Dec. 30, 2013

(65) Prior Publication Data

US 2014/0182138 A1 Jul. 3, 2014

Related U.S. Application Data

(60) Provisional application No. 61/780,086, filed on Mar. 13, 2013, provisional application No. 61/747,775, filed on Dec. 31, 2012.

(51) Int. Cl.
*B26B 19/38* (2006.01)
*B26B 21/40* (2006.01)

(52) U.S. Cl.
CPC ..... *B26B 19/388* (2013.01); *B26B 19/3806* (2013.01); *B26B 19/3846* (2013.01); *B26B 21/4081* (2013.01); *Y10T 29/49826* (2015.01)

(58) Field of Classification Search
CPC .... A45D 24/36; B26B 19/3853; B26B 19/00; B26B 19/38; B26B 19/3806; B26B 19/3813; B26B 19/382; B26B 19/3826; B26B 19/3873; B26B 19/388; B26B 19/3886; B26B 21/40; B26B 21/405; B26B 21/4056; B26B 21/42; A61B 2034/2068
USPC ..... 132/213, 200, 212, 213.1, 214, 289; 30/30, 34.05, 537, 123; 83/76.1, 76.2, 83/76.7, 76.8, 76.9, 81, 23, 13, 522.15; 700/302
See application file for complete search history.

(56) References Cited

U.S. PATENT DOCUMENTS

| | | | | | |
|---|---|---|---|---|---|
| 1,192,085 | A | * | 7/1916 | Marchins | 30/198 |
| 2,480,920 | A | * | 9/1949 | Gullong | 30/202 |
| 2,864,162 | A | * | 12/1958 | MacDonald | 30/537 |
| 2,915,070 | A | * | 12/1959 | Benson | 132/213 |
| 3,054,183 | A | | 9/1962 | Zucker | |
| 3,233,614 | A | * | 2/1966 | Lefcoski | 132/213 |
| 3,241,562 | A | * | 3/1966 | Gronier | 132/213 |
| 3,272,209 | A | * | 9/1966 | Kraus | 132/213 |
| 3,274,682 | A | * | 9/1966 | Worthington | 30/34.05 |
| 3,413,985 | A | | 12/1968 | Dlouhy et al. | |
| 3,536,079 | A | * | 10/1970 | Dlouhy | A45D 44/06 132/200 |
| 3,570,500 | A | * | 3/1971 | Berry | 132/213 |

(Continued)

FOREIGN PATENT DOCUMENTS

| | | | |
|---|---|---|---|
| EP | 1935365 | * | 6/2008 |
| FR | 2964023 A1 | | 3/2012 |

(Continued)

*Primary Examiner* — Rachel R Steitz
*Assistant Examiner* — Brianne E Kalach

(57) ABSTRACT

Embodiments of a hair cutting device for use with automated hair cutting systems are disclosed herein. In one embodiment, a hair cutting device comprises a body having a proximal end and a distal end. A cutter head is attached to the distal end of the body, the cutter head configured for manipulating and cutting hair. The hair cutting device further comprises a plurality of sensors coupled to the body for sensing a position of the cutter head relative to a user's head.

20 Claims, 14 Drawing Sheets

(56) References Cited

U.S. PATENT DOCUMENTS

| | | | | |
|---|---|---|---|---|
| 3,678,944 | A * | 7/1972 | Berry | 132/213.1 |
| 4,602,542 | A | 7/1986 | Natrasevschi | |
| 5,146,680 | A * | 9/1992 | Bakhos | 30/34.05 |
| 5,979,060 | A * | 11/1999 | Holzbauer | B26B 19/20 30/200 |
| 6,009,623 | A * | 1/2000 | Orloff | 30/41.7 |
| 6,497,043 | B1 * | 12/2002 | Jacobsen | 30/34.05 |
| 6,973,931 | B1 | 12/2005 | King | |
| 7,788,810 | B2 * | 9/2010 | Noble | 30/41.5 |
| 8,061,041 | B2 * | 11/2011 | Jessemey et al. | 30/45 |
| 8,065,802 | B2 * | 11/2011 | Oglesby et al. | 30/50 |
| 2002/0119428 | A1 * | 8/2002 | Vitale | 434/94 |
| 2004/0004559 | A1 | 1/2004 | Rast | |
| 2004/0098862 | A1 * | 5/2004 | Orloff | 30/41.7 |
| 2005/0216035 | A1 * | 9/2005 | Kraus | B26B 19/10 606/133 |
| 2007/0227011 | A1 * | 10/2007 | Caric | 30/123 |
| 2008/0051768 | A1 * | 2/2008 | Stumpf | A61B 90/39 606/1 |
| 2008/0052911 | A1 * | 3/2008 | Kohler | 30/41.7 |
| 2008/0114375 | A1 * | 5/2008 | von Jako | A61B 34/20 606/130 |
| 2008/0289192 | A1 * | 11/2008 | Martelli | 30/233.5 |
| 2009/0303320 | A1 | 12/2009 | Davis | |
| 2010/0186234 | A1 * | 7/2010 | Binder | 30/34.05 |
| 2011/0018985 | A1 | 1/2011 | Zhu | |
| 2011/0314677 | A1 * | 12/2011 | Meier et al. | 30/41.8 |
| 2012/0222316 | A1 * | 9/2012 | Chiodo et al. | 30/275.4 |
| 2012/0233866 | A1 * | 9/2012 | Kammer | 30/201 |
| 2012/0234146 | A1 * | 9/2012 | Lakin | 83/76.2 |
| 2013/0021460 | A1 * | 1/2013 | Burdoucci | 348/77 |
| 2014/0137883 | A1 * | 5/2014 | Rothschild | 132/200 |
| 2015/0051845 | A1 * | 2/2015 | Alhashemi | 702/34 |

FOREIGN PATENT DOCUMENTS

| | | | |
|---|---|---|---|
| GB | 2462812 | A | 2/2010 |
| WO | 2013096572 | A1 | 6/2013 |
| WO | WO2013163999 | A1 * | 11/2013 |

* cited by examiner

HAIR CUTTING DEVICE FOR AUTOMATED HAIR CUTTING SYSTEM

CROSS REFERENCE TO RELATED APPLICATION

This application claims the benefit of U.S. Provisional Application Ser. No. 61/747,775, filed by Matthew W. Krenik on Dec. 31, 2012, entitled "Hair Cutting Device for Automated Hair Cutting System"; and U.S. Provisional Application Ser. No. 61/780,086, filed by Matthew W. Krenik on Mar. 13, 2013, entitled "Techniques for Automated Hair-Cutting System," the entire contents of both are incorporated herein by reference.

FIELD OF THE DISCLOSURE

Embodiments of this disclosure relate to improved designs for hair cutting devices for automated hair cutting systems. These improved designs may provide more options for how a hair cutting device is held in a human hand and maneuvered, improved location of position sensors and cameras, improved balance, improved cutter head actuation, attachment of electrically powered accessories, and additional benefits.

BACKGROUND

International application number PCT/US12/70856, filed by Matthew W. Krenik on Dec. 20, 2012, entitled "Automated Hair Cutting System and Method of Operation Thereof," (hereinafter "Krenik '856") provides a description of automated hair cutting systems. These systems operate by determining the position and/or orientation of a hair cutting device relative to a user receiving a haircut. Hair may be collected in a cutter head and extended for cutting to a beneficial length. Through electronic measurements and computational analysis, the location of where hair on the scalp of a user is collected into a cutter head may be determined and as hair is extended and slides through a cutter head, its length may be substantially determined so that a cutter head may be actuated at a beneficial time to cut hair to a beneficial length.

Krenik '856 relates to multiple hair cutting devices that include sensors suitable for determining the position and/or orientation of a hair cutting device relative to the head of a user receiving a haircut. Since the use of an automated hair cutting system involves manipulation of a hair cutting device around the head of a user, hair cutting devices that may be grasped in multiple ways, that have sensors positioned so that they may extend around a hand or between the fingers of a hand grasping a hair cutting device so that they are less likely to be blocked by such a hand, are balanced to improve ease of manipulation, are designed to interoperate with positioning devices so that interference between a hair cutting device and a positioning device is minimized, incorporate structures to support sensors that may be folded or adjusted, and may be interfaced with electrically powered accessories are highly desirable.

U.S. patent application Ser. No. 14/051,201 filed by Matthew W. Krenik on Oct. 10, 2013, entitled "Cutter Head for Automated Hair Cutting System," (hereinafter "Krenik '201") provides embodiments of cutter heads suitable for use with automated hair cutting systems. The embodiments of hair cutting devices shown in this patent application may utilize the cutter heads shown in Krenik '201, the cutter heads described in this patent application, or other suitable cutter heads. U.S. patent application Ser. No. 14/086,497 filed by Matthew W. Krenik on Nov. 21, 2013, entitled "Sensing and Control Techniques for Automated Hair Cutting System," (hereinafter "Krenik '497") provides embodiments of sensing, actuation, and control systems for cutter heads for automated hair cutting systems. The embodiments of hair cutting devices shown in this patent application may utilize the sensing, actuation, and control systems shown in Krenik '497, those described in this patent application, or other suitable sensing, actuation, and control systems.

SUMMARY

In one embodiment, a cutting device for use with an automated hair cutting system is disclosed. The cutting device comprises a body having a proximal end and a distal end. A cutter head is attached to the distal end of the body, the cutter head is configured for manipulating and cutting hair. The cutting device further comprises a plurality of sensors coupled to the body for sensing a position of the cutter head relative to a user's head.

In one embodiment, there is disclosed an automated hair cutting system. The system comprises a positioning apparatus including a support apparatus for supporting the positioning apparatus about a user's head and the positioning apparatus having positioning interfaces positioned about the support apparatus; a computing device including a user interface; and a cutting device. The cutting device comprises a body having a proximal end and a distal end; a cutter head attached to the distal end of the body, the cutter head configured for manipulating and cutting hair; and a plurality of sensors coupled to the body for sensing a position of the cutter head relative to the user's head. The cutting device may be configured to communicate with the computing device, and in some embodiments, the plurality of sensors are positioned such that the cutting device and positioning apparatus may be used in conjunction with each other.

In yet another embodiment, a method of manufacturing a cutting device for use with an automated hair cutting system for cutting hair on a user's head is disclosed. The method comprises forming a body having a proximal end and a distal end and coupling a cutter head to the distal end of the body, the cutter head configured for manipulating and cutting hair. The method further comprises coupling a plurality of sensors to the body and configuring the plurality of sensors for sensing a position of the cutter head relative to the user's head.

DETAILED DESCRIPTION

Figure 1:
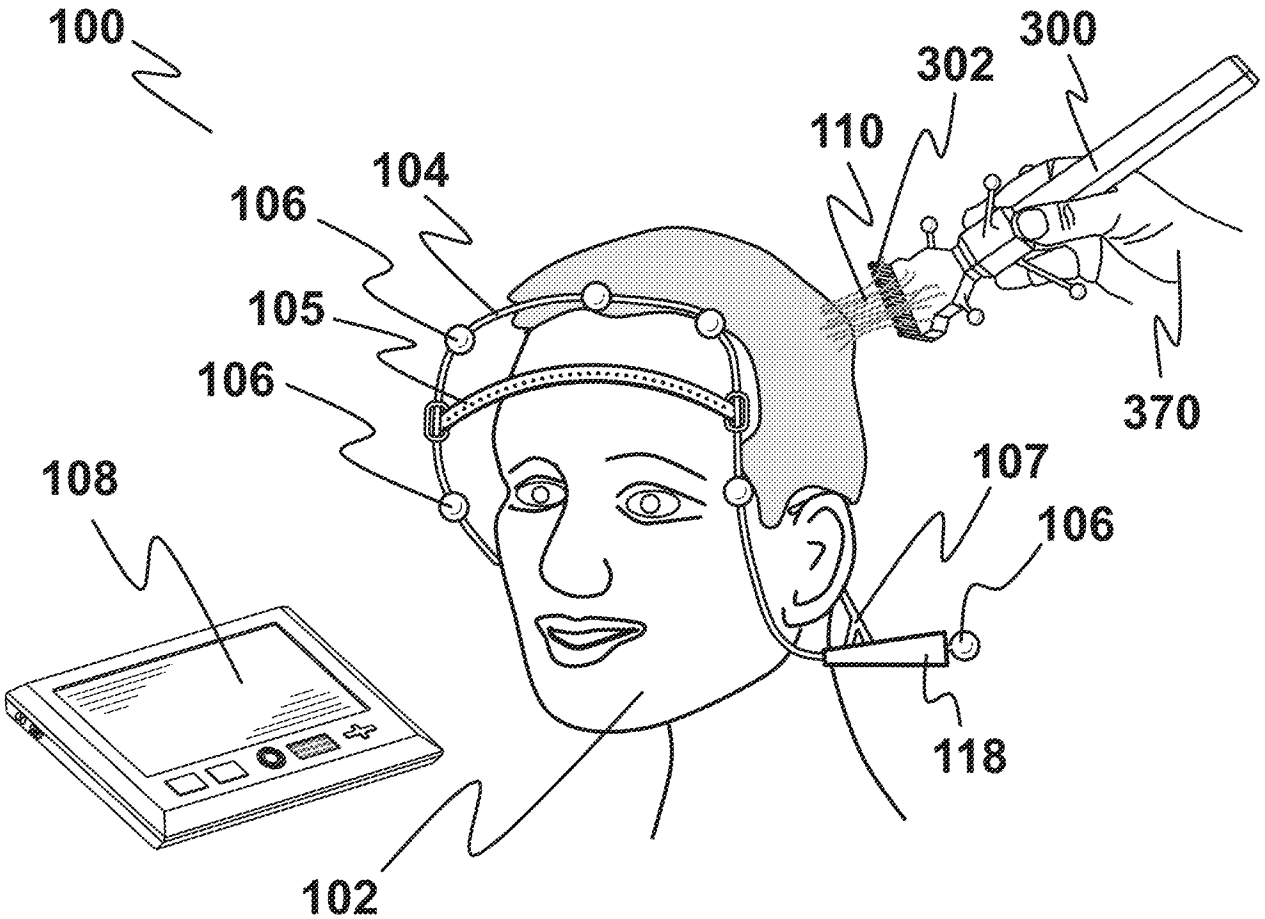
FIG. 1 is an environmental view of an automated hair cutting system having a cutting device according to the present disclosure.

Embodiments of this disclosure include techniques for how position sensors or cameras on a hair cutting device for use in an automated hair cutting system are located and mounted and how hair cutting devices may be constructed for beneficial use. Such improved locations and mounts may allow persons using an automated hair cutting system more options for how to hold and maneuver a hair cutting device so that they may more comfortably and effectively achieve desirable results. Such improved locations and mounts may also allow position sensors or cameras to be substantially less likely to be blocked so that they are more effective in providing signals that may be used to determine the position and/or orientation of a hair cutting device. Such improved locations and mounts may also be implemented so they are substantially less likely to snag hair that may be in close proximity to them in the course of providing a haircut. Improved construction of hair cutting devices may allow them to be grasped in multiple ways and to be manipulated more easily than may otherwise be possible. Hair cutting devices may include a main body from which a handle extends. A main body may house electronics, actuators, and other system elements and may also attach or adjoin an additional body or bodies that may also house system elements. Embodiments of this disclosure may also include improved balance of hair cutting devices. Improved balance may improve user comfort and may also allow a hair cutting device to be more easily maneuvered for beneficial results. Improved balance may be achieved by preferred location of batteries, electronics, and other internal elements of a hair cutting device, and may also include use of ballast weights.

Hair cutting devices may also be designed to interoperate with specific positioning devices and may have physical dimensions and placement of sensors and supporting structures that are configured to minimize undesired interference between a hair cutting device and a positioning device. In some possible embodiments, a hair cutting device may have sensor supporting structures that are larger, so that sensors may be more broadly spaced, on a side of a hair cutting device from which cutter head teeth substantially emanate and point away from and sensor supporting structures that are smaller, so that they interfere less with a positioning device, on the side of the hair cutting device opposite the direction that cutter head teeth substantially point. Hair cutting devices may include relief areas between a cutter head supporting structure and a main body so that a cutter head may be more easily manipulated around ears and other features of a user's head. Actuators and cutter head drive mechanisms may be designed to allow such relief areas and may provide variable forces on cutter heads to reduce friction and power levels used during some phases of cutter head operation and provide reliable cutting action in other phases of cutter head operation. Structures or posts supporting sensors on hair cutting devices may be folded for compact storage or may be adjusted in the course of operation. Structures supporting sensors may provide passive channels or guides so that positioning signals may propagate around or inside a supporting structure to sensing electronics located some distance from the point where a positioning signal is actually sensed. Accessories, such as an electrically powered shaving accessory, trimmer, hair thinning cutter, or other useful accessory, may be mounted to and be powered and/or controlled by a hair cutting device. And unpowered accessories may also be mounted to and possibly controlled by a hair cutting device.

Referring now to the drawings and more specifically to FIG. 1, there is shown an automated hair cutting system 100 cutting a region of hair 110 on a user 102. An electronic computing device 108 may communicate and interact with a positioning device 104 having a plurality of positioning interfaces 106 and with a hair cutting device 300. Embodiments of automated hair cutting systems such as automated hair cutting system 100 are described in more detail in Krenik '856. Hair cutting system 100 is shown in FIG. 1 utilizing hair cutting device 300 according to one embodiment of the present disclosure. The hair cutting device 300 includes cutter head 302. Hair cutting system 100 may operate through observation of and/or interaction with user 102 and/or positioning device 104 by hair cutting device 300, or other system elements which enable determining the position and/or orientation of hair cutting device 300 relative to the head of user 102 such that selected regions of hair 110 may be collected, extended to a length, and cut by cutter head 302 of hair cutting device 300. Additional embodiments, modes of operation and additional description of automated hair cutting system 100 may be found in Krenik '856.

Alternate embodiments of an automated hair cutting system are possible which do not utilize a positioning device, but rather use some combination of cameras, motion sensors, accelerometers, gyroscopes, and/or other sensors to determine the position and/or orientation of hair cutting device 300 relative to the head of a user. Other embodiments of automated hair cutting system 100 which use a positioning device may be combined with the use of some combination of cameras, motion sensors, accelerometers, gyroscopes, and/or other sensors to facilitate determining the position and/or orientation of a hair cutting device 300 relative to the head of a user.

In FIG. 1, hair cutting device 300 is shown supported by human hand 370. Hair cutting device 300 provides a novel arrangement of sensors and construction for use with an automated hair cutting system such as automated hair cutting system 100. Positioning device 104 may be supported on the head of user 102 with a support apparatus, which may comprise ear supports 107 and head band 105. Housing 118 may contain batteries, electronics, or other elements. The support apparatus and other features of positioning device 104 utilize a tubular construction, but those skilled in the art will recognize that alternative structures and constructions for positioning devices may also be used.

Figure 3A:
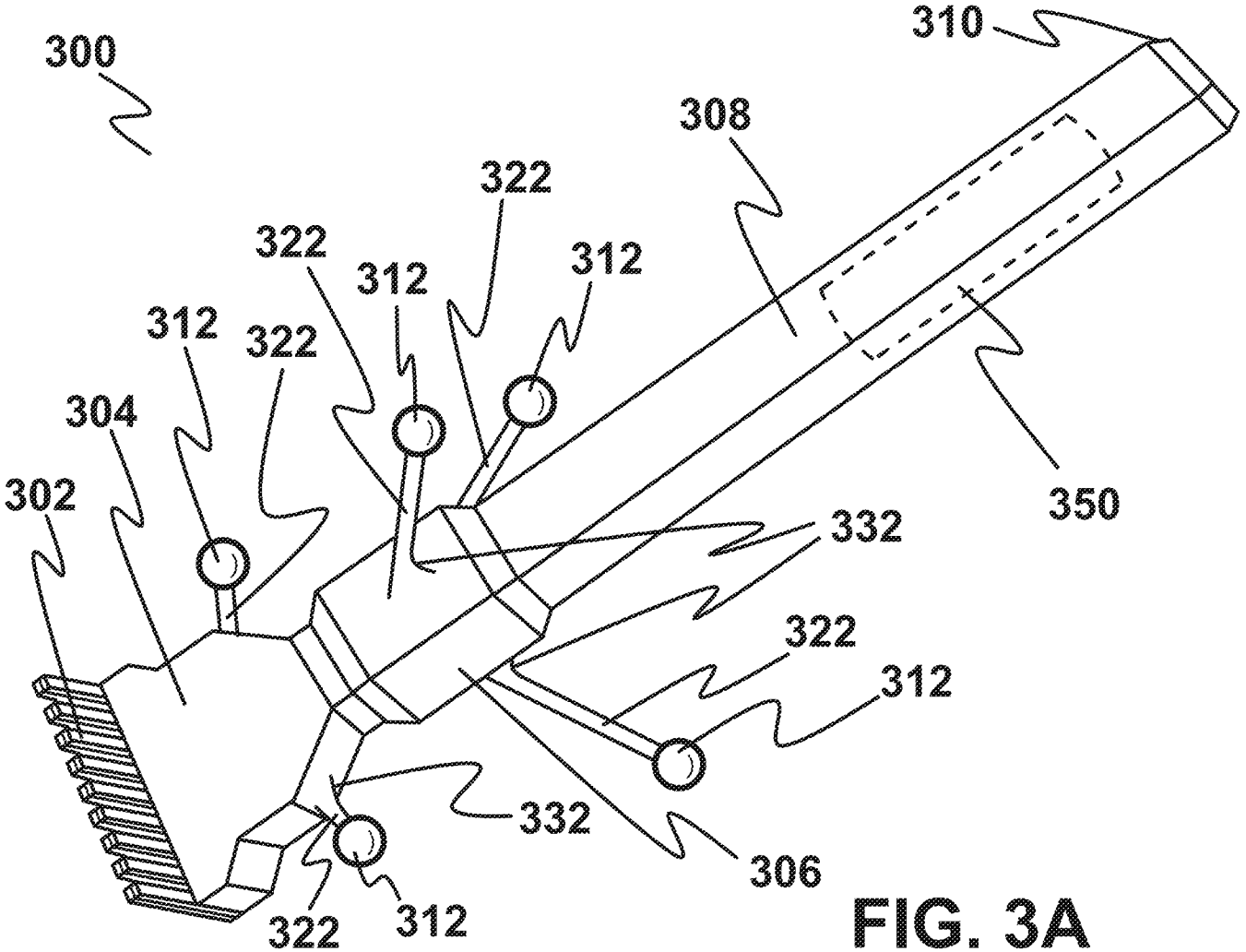
FIG. 3A shows a perspective view of an embodiment of a hair cutting device according to the present disclosure which may be used in the system shown in FIG. 1.
Figure 3B:
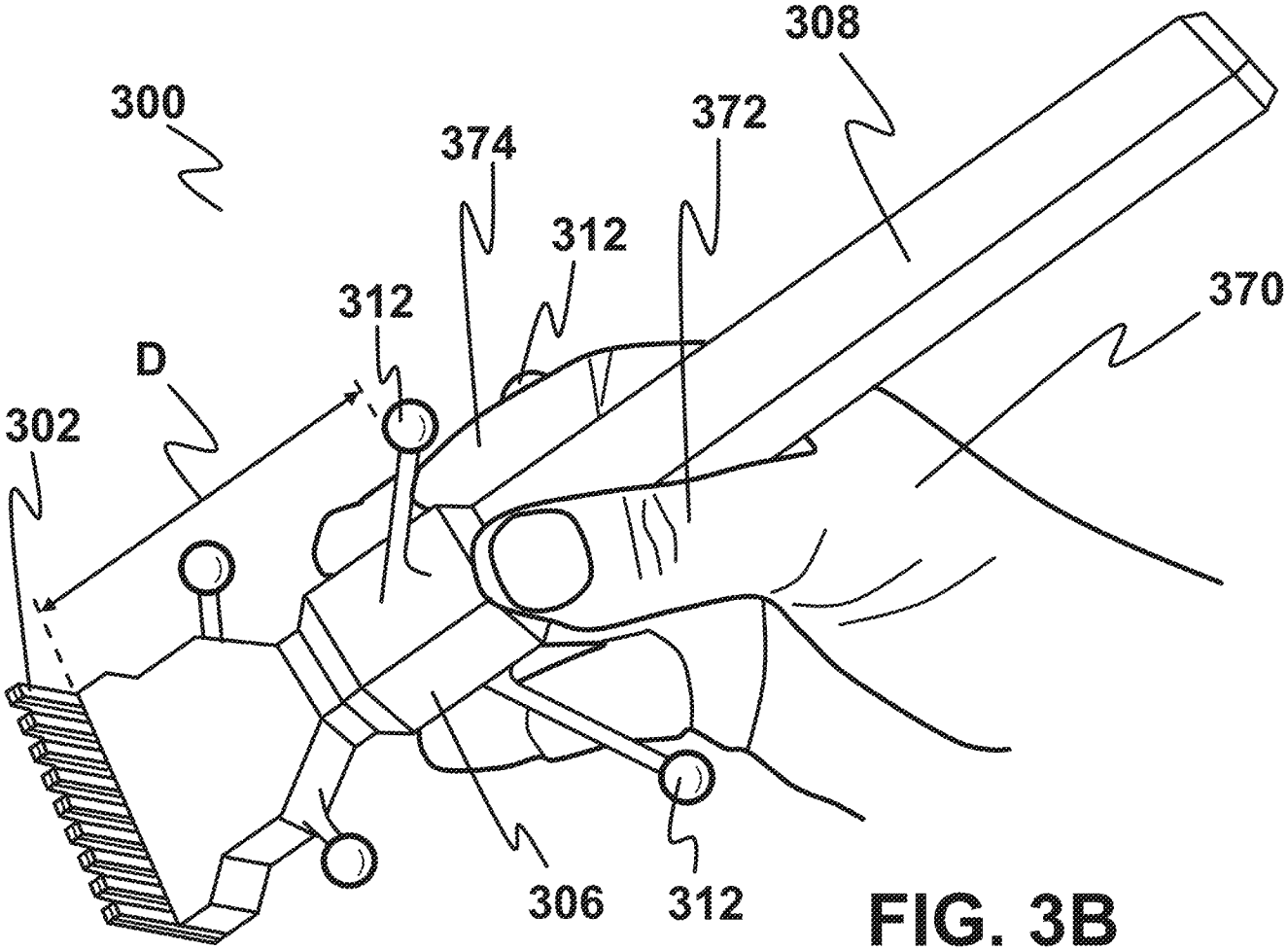
FIG. 3B shows one embodiment of manipulating the hair cutting device shown in FIG. 3A.
Figure 3C:
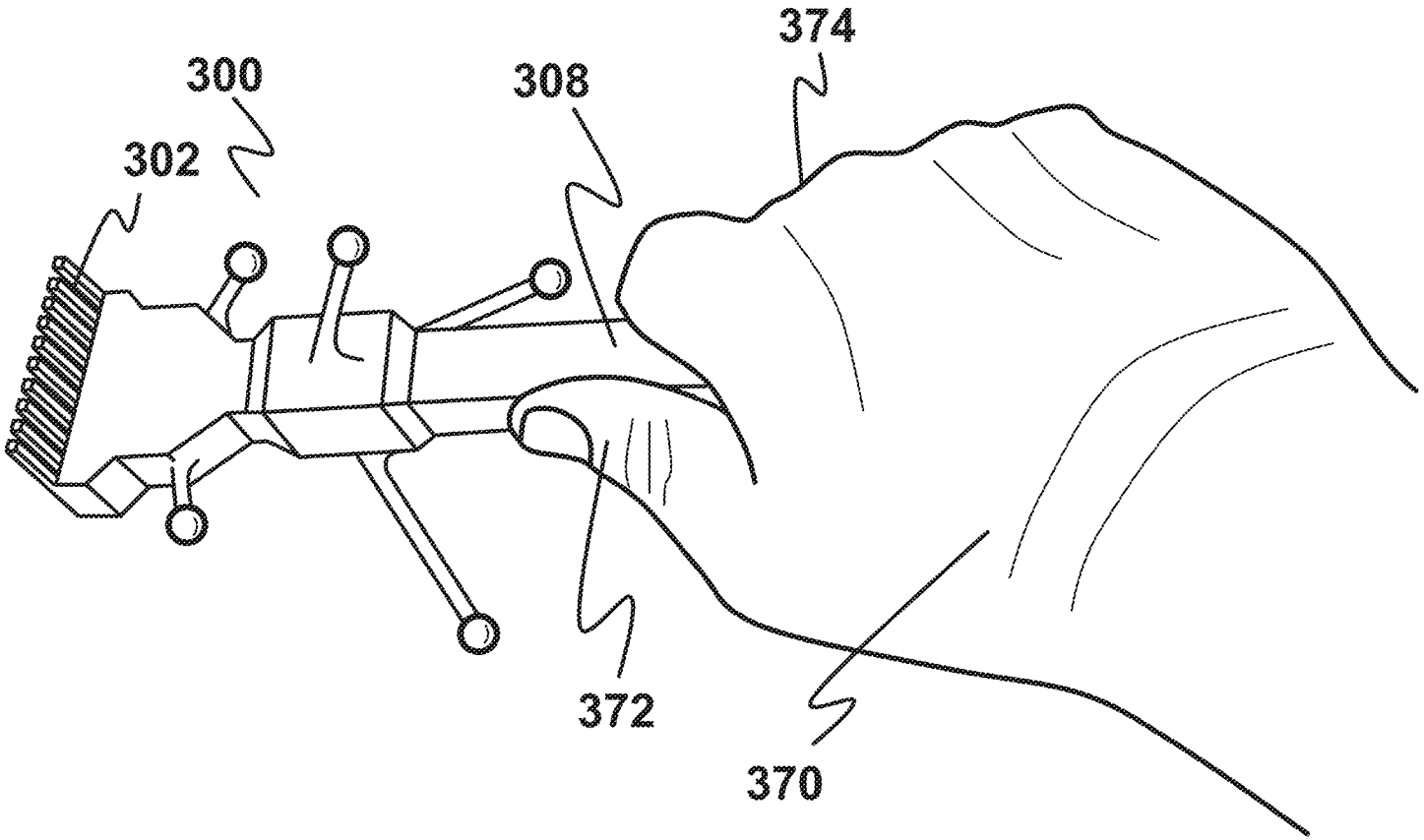
FIG. 3C shows another embodiment of manipulating the hair cutting device shown in FIG. 3A.

Embodiments of automated hair cutting systems may include positioning signals between the positioning interfaces 106 on positioning device 104 and sensors on hair cutting device 300 as will be shown and discussed in more detail with regard to FIGS. 3A-3C. The positioning signals may be electromagnetic signals, sound signals, light signals, magnetic signals, acoustic signals, ultrasonic signals, or other types of signals and may propagate from any of the positioning interfaces 106 to any of the sensors on hair cutting device 300. Analysis of these positioning signals may be used in computation of the position and/or orientation of hair cutting device 300 relative to user 102, and may include measurement of signal propagation times and distances from positioning interfaces to sensors, or other aspects of positioning signals that may be beneficial for some embodiments. Computation of the position and/or orientation of hair cutting device 300 relative to user 102 may be undertaken in electronic computing device 108, hair cutting device 300, positioning device 104, or other possible system elements that may be present in some embodiments of automated hair cutting systems 100. Some embodiments of automated hair cutting system 100 may also comprise a camera or cameras on hair cutting device 300, positioning device 104, electronic computing device 108, or other system elements that may collect images or video of positioning device 104, user 102, or hair cutting device 300, so that analysis of those images or video may be used in computation of the position and/or orientation of hair cutting device 300 relative to user 102. In Krenik '856, more explanation is provided for a wide range of signal types, signal coding, signal modulation, and types of sensors or transducers that may be used to generate and/or sense these positioning signals, and many other aspects for various embodiments of signals, interfaces, cameras, sensors, and other elements or signals for automated hair cutting systems 100. Embodiments of hair cutting devices, such as cutting device 300, will be explained in the present disclosure which may improve the ability to accurately and reliably generate and/or sense signals, images, video, or other useful information for use in determining position and/or orientation of a hair cutting device relative to the head of a user 102.

Figure 2:
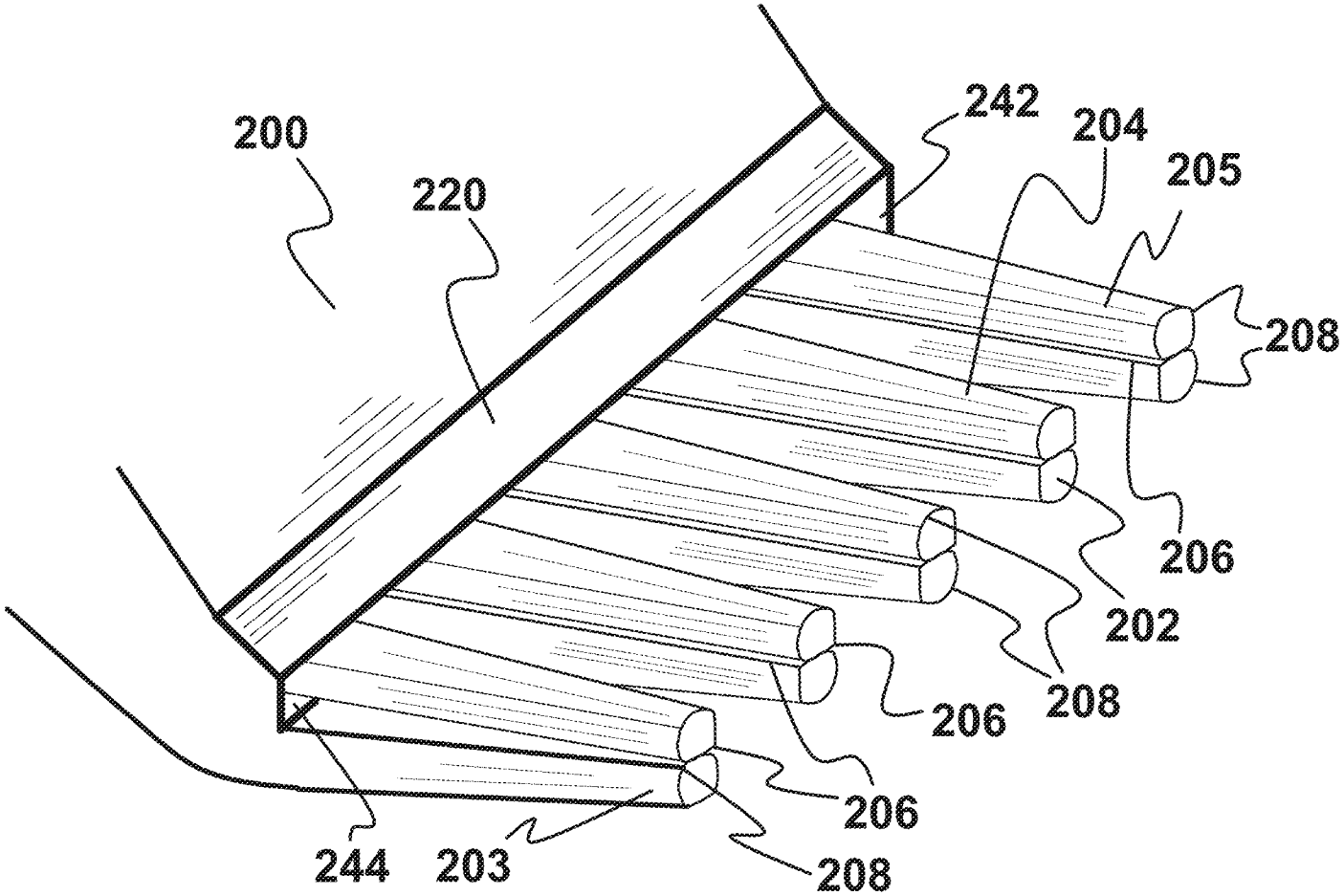
FIG. 2 shows a perspective view of an embodiment of a cutter head which may be used with the automated hair cutting system shown in FIG. 1.

FIG. 2 shows an embodiment of a cutter head 200 for use in hair cutting devices such as hair cutting device 300 that allows hair to be collected, allows actuation of the cutter knives 204 in a first direction to apply pressure and friction to hair so that it may be manipulated and extended, and provides cutting action when the cutter knives 204 are actuated in a second direction. Cutter head 200 of FIG. 2 comprises cutter knives 204, comb teeth 202, and body 220. Cutter head 200 may be actuated so that cutter knives 204 are substantially above comb teeth 202 so that hair may be collected in cutter head 200 (the view of FIG. 2 shows cutter knives 204 in such a position). Cutter head 200 may be actuated so that cutter knives 204 move to the left (toward the lower left corner of FIG. 2) so that rounded edges 208 of cutter knives 204 and comb teeth 202 apply pressure to hair collected in cutter head 200. Application of pressure to hair collected into cutter head 200 may improve the ability to manipulate hair collected in cutter head 200 as the resulting friction may help to keep hair in cutter head 200 so that it is less likely to fall out. And cutter head 200 may be actuated so that cutter knives 204 move to the right (toward the upper right corner of FIG. 2) so that sharp edges 206 of cutter knives 204 and comb teeth 202 meet and pass over each other to provide a cutting action (much as the blades of a common pair of scissors pass over each other to provide cutting action). Left most comb tooth 203 and right most cutter knife 205 have only rounded edges 208 and have no sharp edges 206 as left most comb tooth 203 and right most cutter knife 205 are not utilized for cutting hair during a cutting stroke of cutter head 200. Gap 242 and gap 244 provide spacing between cutter knives 204 (including right most cutter knife 205) and body 220 so that they may move to the right and left. Cutter head 200 may be fabricated from metals, ceramics, glass, sapphire, and other suitable materials. Cutter head 200 or other possible cutter head embodiments may be utilized for cutter head 302 as shown on hair cutting device 300 and on other hair cutting devices shown in this patent application. Krenik '201 provides additional description of cutter heads similar to cutter head 200 and also describes additional embodiments of cutter heads suitable for some embodiments of hair cutting devices.

The teeth of a cutter head may be pointed in different directions. In FIG. 2, the teeth of cutter head 200 that emanate from the side of body 220 visible in FIG. 2 are pointed away from body 220, and are pointed substantially toward the lower right side of FIG. 2 in the view shown. This convention, that cutter head teeth point in the direction from which hair may enter a cutter head, is used consistently throughout this patent application.

Cutter heads, such as cutter head 200 as shown in FIG. 2, cutter heads shown in Krenik '201, and other possible cutter head embodiments, utilized in automated hair cutting system 100 may be used in multiple ways in the course of delivering a haircut to a user 102. For example, cutter head 200 may include sensors and actuators that allow the position of cutter knives 204 relative to comb teeth 202 to be sensed and controlled by electronic circuitry controlling cutter knives 204 (see Krenik '201 and Krenik '497 for more information on sensing and controlling cutter heads). Control and sensing of cutter knives 204 may allow some embodiments of automated hair cutting system 100 to estimate the amount of hair collected in a cutter head 200. With such an estimate, a cutter head 200 may be controlled such that sufficient force is provided to cut hair without providing so much force as to create unnecessary levels of vibration or jarring of a hair cutting device. For some hair styling techniques, it may be desirable to not fully cut the hair in a cutter head 200 and to only cut some of the hair that has been collected. For example, some hair cutting techniques involve thinning or layering of hair on some regions of a user's 102 head. For such a technique, cutter knives 204 may be actuated to cut some, but not all, of the hair collected in a cutter head 200 and this may be achieved by partially actuating cutter knives 204 through a cutting stroke, and then returning cutter knives 204 to a position suitable for extension and possibly the application of friction to hair, so that only a portion of hair collected in cutter head 200 is cut. Multiple cycles of actuation of cutter head 200 to partially cut hair while it is extended may allow the thickness or weight of hair on the head of a user 102 to be tapered along the length of the hair and such multiple cycles of actuation for partial cutting may be sequenced automatically based on the position of a hair cutting device 300 relative to the head of a user 102.

Another common hair cutting technique is to cut hair at various angles with a scissors to create a randomized or feathered texture to hair and to avoid abrupt straight cuts to hair that may be visible and possibly unsightly. A similar technique may be achieved with a cutter head 200 under automatic sensing and control by vibrating cutter knives 204 back and forth within a limited range of motion while hair is extended through an interval including a length at which multiple partial cutting strokes of cutter knives 204 are used to achieve a certain desired hair length. A single abrupt cutting stroke of cutter head 204 is avoided and replaced by multiple partial cutting strokes, possibly culminating in a complete cutting stroke, so that hair is somewhat randomly cut to slightly variable lengths within a controlled range so that a more natural or feathered result is achieved in a user's 102 cut hair. Those skilled in the art will recognize that a cutter head, such as cutter head 200 shown in FIG. 2, may be controlled so that hair may be collected, extended, maneuvered, partially cut, fully cut, randomly cut within pre-determined bounds to the desired length for a given region of collected hair, thinned, or otherwise cut to generate desirable textures, patterns, features, or other possible desirable effects in hair.

Referring now to FIGS. 3A-3C, there is shown one embodiment of a hair cutting device according to the present disclosure and various configurations for manipulating and supporting hair cutting device 300. In FIG. 3A, there is shown hair cutting device 300 comprising cutter head 302, actuator body 304, main body 306, and handle 308. Handle 308 comprises handle end 310, which may be formed having chamfered corners, although other embodiments may comprise rounded, square or otherwise finished corners. Handle 308 may include grips, which may include rubber grips, plastic grips, grips made of other materials, texturing, smooth or roughened finishes, or other suitable finishes. Although handle 308 is shown having a square cross-section, other embodiments may use round, octagonal, hexagonal, oval, elliptical, triangular, or other possible cross-sections. Handle 308 may also include contours, reliefs, or other shapes to augment comfort, augment the ability of a person to securely grasp handle 308, or provide other or additional benefits.

Handle 308 is shown in FIG. 3A as a hollow handle with battery 350 positioned inside. While only one battery 350 is shown in FIG. 3A, some embodiments may use multiple batteries, longer batteries, batteries that are flat, square, or other shapes as opposed to the cylindrical battery shown in FIG. 3A. Battery 350 may be a one-time-charged replaceable battery or may be rechargeable. In some embodiments, handle 308 may be removable, have a removable cap on handle end 310, or other configurations which enable access and/or replacement of battery 350. In some embodiments hair cutting device 300 may be powered from a power cord or other wired cord capable of delivering power to operate hair cutting device 300, charge batteries in hair cutting device 300, or both. Wireless powering or charging of hair cutting device 300 may also be possible for some embodiments.

Cutter head 302 may be configured similarly to cutter head 200, or may be similar to other cutters heads such as those shown and described in Krenik '856, Krenik '201, or other possible cutter heads. Cutter head 302 may comprise reciprocating cutters, cutter teeth, rotary cutters, laser cutters or any other type of suitable cutter design. Actuator body 304 may contain a motor, solenoid, voice coil motor, gears, levers, mechanical features, magnetic elements, electronics, motor drivers, or other electrical and/or mechanical elements that may be configured to provide motion to drive cutter head 302. Cutter head 302 may comprise sensing and controlling cutter knives or other cutter head 302 elements to allow various manipulations of hair, including, but not limited to collection, extension, partial cutting, or fully cutting of hair. Cutter head 302 is shown having teeth extending in front of the face of actuator body 304 at a substantially right angle to the face of actuator body 304. Those skilled in the art will recognize that additional embodiments in which the teeth of cutter head 302 extend in front of actuator body 304 at smaller or larger angles than a right angle are possible and may offer benefits in how hair cutting device 300 may be manipulated for some possible embodiments. Embodiments in which the teeth of cutter head 302 extend substantially in parallel away from actuator body 304 (that is, extend outward from actuator body 304 substantially opposite in direction from the direction of main body 306 and substantially parallel to handle 308) or extend in other directions are also possible.

As cutter head 302 and actuator body 304 may be constructed from or contain metals, cutting elements, actuators, and other elements, the distal end of hair cutting device 300 near cutter head 302 may be somewhat heavier than the proximal end of hair cutting device 300 near handle end 310. For some embodiments, the weight may make gripping and maneuvering hair cutting device 300 somewhat cumbersome and inconvenient. Some embodiments may benefit from battery 350 placed inside handle 308 at a location such that the weight of battery 350 counters the weight of cutter head 302 and actuator body 304, thereby facilitating a more balanced hair cutting device which is easier and more convenient to maneuver. In addition to battery 350, other elements of hair cutting device 300 may be distributed inside handle 308, main body 306, and actuator body 304 to benefit balance. Additionally, ballast, other weights, or alternations in the materials, construction, and other elements of hair cutting device 300 may be arranged which facilitate a balanced weight distribution of hair cutting device 300.

Main body 306 may contain electronics, signal processing functions, batteries, power electronics, control electronics, accelerometers, gyroscopes, orientation sensors, motion sensors, analog electronics, digital electronics, communications electronics, interfaces, motors, actuators, buttons, cameras, illumination sources, and other elements beneficial for a hair cutting device 300. Main body 306 may be configured in various ways and shapes which facilitate manipulation and support of cutting device 300. Main body 306, actuator body 304, and handle 308 together form a central structure of hair cutting device 300. Many alternative options and configurations of a central structure are possible and may include multiple bodies, housings, handles, grips, knobs, and other alternative structures. Accordingly, one benefit of some embodiments of hair cutting device 300 is incorporation of a central structure with one or more positioning sensors, one or more cameras, and/or other sensors mounted away from the central structure so that a person's hand may extend substantially between the central structure and one or more of the positioning sensors, cameras, and/or other sensors.

While not shown in FIG. 3A, hair cutting device 300 may include indicator lights, switches, buttons, safety buttons, electronic displays, touch screen displays, bells, chimes, speakers, microphones, a camera or cameras, video cameras, an illumination source, an illumination source suitable for producing structured light, gyroscopes, compasses, accelerometers, electrical communication interfaces, electrical charging interfaces, electrical power interfaces, wired interfaces, wireless interfaces, and other elements. Those skilled in the art will recognize that hair cutting device 300 of FIG. 3A may also include other or additional features including adjustable or removable combs, adjustable or removable spacers, accommodations for connection of a vacuum cleaner, accessories, and other elements commonly found on hair clippers, hair trimmers, or other consumer appliances.

Certain embodiments of hair cutting device 300 may contain a touch sensor on the base of cutter head 302 that allows hair cutting device 300 to monitor when it touches the scalp of a user 102 and may offer additional capability to measure distance from the scalp of user 102 to hair cutting device 300 (see Krenik '856 for additional information on touch sensors). Use of a touch sensor to signal that cutter head 302 is against the scalp of a user 102 may provide an indication that cutter head 302 has collected hair and extension of hair for cutting may begin. Some embodiments of touch sensors may allow the spongy, elastic, or compliant nature of a human scalp to be sensed and some embodiments of automated hair cutting devices 100 may keep estimates of how spongy, elastic, or compliant a human scalp is relative to position on the human scalp so that differences in how the scalp springs up after being pressed against by cutter head 302 may be accounted for in hair length measurements. Those skilled in the art will recognize that areas of a human scalp composed primary of skin over bone tend to be harder and less compliant while areas such as the back of a human neck where skin is substantially over muscle and other body tissue tend to be more compliant. As hair cutting device 300 is lifted away from a human scalp to extend and cut hair, the level to which the scalp is compliant and springs up, and also may be pulled upward by the action of extending hair, may impact measurements of how long hair has been extended and compensation of these effects may lead to improved results. Embodiments of touch sensors that may provide variable or light pressure in monitoring contact with a scalp and embodiments making use of multiple touch sensors on the base of a cutter head 302 are also possible.

Some embodiments of automated hair cutting system 100 may not utilize touch sensors on hair cutting devices 300, and may instead utilize knowledge of the position and/or orientation of hair cutting device 300 to determine that hair cutting device 300 is resting in a substantially stationary position on user's 102 scalp, as a signal that hair has been collected in cutter head 302. Still other embodiments of hair cutting devices may include a button, switch, voice response control, or other technique for a user 102 to signal that hair has been collected in cutter head 302. And it is also possible in some embodiments to use different methods to signal that hair has been collected in cutter head 302 and that extension of hair for cutting may begin. For example, some embodiments of automated hair cutting system 100 may utilize a touch sensor on the base of cutter head 302 to signal that hair is collected in cutter head 302 on regions of a user's 102 scalp where the scalp is harder and less compliant, but require a user 102 to press a button to signal that hair has been collected in cutter head 302 in regions of user's 102 scalp where the scalp is more spongy, elastic, and complaint (such as on the back of user's 102 neck).

Hair cutting device 300 comprises a plurality of sensors 312 mounted on a plurality of sensor posts 322. While only five sensors are shown and described in the embodiment shown in FIG. 3A, other embodiments may contain more sensors or less sensors, according to various desired users and configuration requirements. Sensors 312 are shown as spherical elements. Sensors on a hair cutting device such as hair cutting device 300 shown in FIG. 3A, or other possible embodiments of hair cutting devices may sense electrical, magnetic, electromagnetic, sound, acoustic, ultrasonic, optical, light, infrared light, ultraviolet light, visible light, radar, sonar, lidar, or many other types of signals generated at positioning interfaces 106 on a positioning device 104. In some embodiments, transmitters may be used in place of the sensors of the hair cutting device such that signals for computation of position and/or orientation may be generated at a hair cutting device 300 or other possible hair cutting devices and sensed at positioning interfaces (such as positioning interfaces 106 as shown in FIG. 1). Embodiments in which some signals are generated and others are sensed on a hair cutting device 300 are also possible. And some sensors and/or positioning interfaces may both generate and sense signals, and in some embodiments may do so simultaneously.

Sensors utilized on a hair cutting device 300 may be of various embodiments to sense signals used for computation of position and/or orientation of a hair cutting device 300 in an automated hair cutting system 100. Hence, sensors 312 may contain antennas, microphones, ultrasound transducers, piezoelectric transducers, accelerometers, gyroscopes, compasses, capacitive transducers, magnetic field sensors, light sensors, photodiodes, cameras, video cameras, passive electronics, active electronics, amplifiers, buffers, wire, waveguides, acoustic pathways, acoustic chambers, or other sensing and/or electronic elements and/or interfacing elements that may be beneficial in generating or sensing positioning signals that may be in use in an automated hair cutting system 100. Spherically shaped sensors 312 such as those shown in FIG. 3A may provide a smooth surface less likely to snag or catch hair. Other possible shapes such as faceted surfaces, hexagonal, octagonal, cylindrical, and other shapes of sensors may also provide benefit for some embodiments. Some embodiments may utilize sensors contained in housings formed from materials through which positioning signals may propagate. Such housings may protect sensors and provide shapes and surfaces that allow hair to flow smoothly over them and avoid snagging or catching hair. In some embodiments, sensors 312 may have a favored direction from which they sense signals more precisely, sense signals at lower power levels, or otherwise favor signals from a certain direction; for such embodiments, some or all sensors 312 may be oriented on hair cutting device 300 so that the favored direction for sensing signals benefits operation of automated hair cutting system 100. For some such embodiments, sensors 312 may be oriented such that their favored direction is directed toward user 102 and/or positioning device 104 in the course of operation of automated hair cutting system 100, so that favorable signal reception from user 102 and/or positioning device 104 occurs. And, for some embodiments, a beneficial orientation for some or all of sensors 312 may be so that their favored direction for sensing positioning signals is directed substantial in parallel to handle 308 and in the direction toward cutter head 302 (so that signals coming substantially from the direction of cutter head 302 and propagating toward the sensors 312 are received favorably).

Some or all of sensors 312 or other elements of hair cutting device 300 may contain cameras directed to collect images of positioning device 104 and/or user 102 while in operation. Additionally, some or all of sensors 312 or other elements of hair cutting device 300 may contain illumination sources to illuminate positioning device 104 and/or user 102 such that cameras are able to provide a better image over a non-illuminated image. Some embodiments may utilize structured light as an additional aid for the collection and analysis of images or video. Those skilled in the art will recognize that structured light may be utilized to provide a pre-defined pattern of light (such as a grid pattern, stripe pattern, or other pattern) that may be recognized in a camera image or video to aid in analysis of such an image or video. Cameras and illumination sources (including those providing structured light) used in automated hair cutting systems may utilize visible light, infrared light, laser light, or other possible wavelengths, colors, or combinations of colors or types of light.

Actuator body 304, main body 306, and handle 308 may be constructed together so that they are joined as a single element as shown in FIG. 3A or they may be constructed separately or in pieces and fastened, screwed, glued, welded, or otherwise joined together. Actuator body 304, main body 306, and handle 308 may be fabricated from wood, plastics, metals, aluminum, stainless steel, combinations of materials, or other suitable materials. Sensors 312 and sensor posts 322 may be fabricated from plastics, wood, aluminum, stainless steel, other metals, electronic materials, semiconductor materials, electronic components, sensor components, silicon, combinations of materials, or other suitable materials. Those skilled in the art will recognize that some embodiments of hair cutting device 300 may benefit from mechanical links between some or all of the sensor posts 322 utilized on such a hair cutting device that may help to mechanically stabilize some or all of the sensor posts. Such mechanical links may include stabilizing members, bands, rings, grids, meshes, or other formations of metals, plastics, wood, or other suitable materials that provide increased rigidity of sensor posts; and may be configured so that hair cutting device 300 may be conveniently gripped and manipulated with substantially little or no interference from these additional mechanical links.

Sensor posts 322 may include contoured attachments 332 where sensor posts are coupled onto the cutting device 300. Contoured attachments 332 may provide a more smoothly contoured surface over which hair may flow smoothly so that snagging or catching hair is made substantially less likely. Other shapes and contour shapes for attachments 322 are also possible. Whereas contoured attachment 332 is embodied in FIG. 3A as a smooth curve, faceted attachments, round arcs, variable radius arcs, multiple arcs, and many other shapes of contoured attachments are possible for various embodiments.

In FIG. 3B, hair cutting device 300 is shown held and manipulated by human hand 370 including thumb 372 and fingers 374. As shown in FIG. 3B, the embodiment of hair cutting device 300 allows human hand 370 to extend to the region substantially between handle 308 and the sensors 312 proximate thereto. Hand 370 is able to grip hair cutting device 300 substantially near cutter head 302 so that hair cutting device 300 may be maneuvered without blocking sensors 312 needed for determination of the position and/or orientation of hair cutting device 300. Those skilled in the art will recognize that hair cutting device 300 shown in FIG. 3B allows many options for holding and maneuvering hair cutting device 300 without blocking sensors.

Embodiments of hair cutting device 300 are also possible in which handle 308 is not present so that main body 306 may be contacted by the palm of hand 370, with fingers 374 and thumb 372 extending substantially between sensor posts 322. Embodiments are also possible in which a shortened version of handle 308 is utilized. Those skilled in the art will recognize that some embodiments of a hair cutting device may utilize a handle 308 that extends from main body 306 at an angle relative to the axis of actuator body 304 and main body 306 that handle 308 is shown parallel to in FIG. 3B. Those skilled in the art will further recognize that some embodiments of a hair cutting device may utilize a handle 308 that extends from main body 306 or from actuator body 304 at a substantially right angle from the orientation of handle 308 as shown in FIG. 3A such that handle 308 may extend from main body 306 or from actuator body to the side thereof so that it lies substantially parallel to the direction that the cutter knives of cutter head 302 may be actuated to achieve cutting action. Those skilled in the art will recognize that use of such a side extending handle may allow an actuator inside actuator body 304 to be partially or fully extended into handle 308 and may allow additional flexibility in the types and construction of actuators used to drive cutter head 302. Cutter head-to-sensor distance D, which measures a distance from cutter head 302 to one of the sensors 312, will be further explained with regard to FIG. 4.

In FIG. 3C, hair cutting device 300 is again shown being held by hand 370, but closer to handle end 310 than shown in FIG. 3B. Gripping handle 308 in the fashion shown in FIG. 3C may be beneficial for a person using an automated hair cutting device 100 for some hair cutting operations. Hence, the embodiment of hair cutting device 300 as shown provides benefit in allowing multiple ways for it to be gripped for various hair cutting operations. It is noted in FIG. 3C that hair cutting device 300 gripped by human hand 370 as shown does not result in any of the sensors of hair cutting device 300 to be blocked from signals propagating toward them from the direction of cutter head 302.

Hair cutting device 300 comprises a central structure including a handle 308, an actuator body 304, and a main body 306. Embodiments are possible in which main body 306, actuator body 304, and/or handle 308 are combined as a single structure so that main body 306, actuator body, and handle 308 may not be distinguishable from each other and are formed to appear and act as a single element. Whether handle 308, actuator body 304, and main body 306 are a single structure or multiple structures, and whether other bodies, handles, or other elements are present in some embodiments, hair cutting device 300 offers benefit as it provides one or more sensors 312 supported some distance from a central structure so that the fingers, thumb, and hand of a person grasping hair cutting device 300 may extend substantially between the central structure and the one or more sensors 312, so that hair cutting device 300 may be grasped without substantially obstructing the one or more sensors 312. Hair cutting device 300 may also be held and manipulated in other ways.

Figure 4:
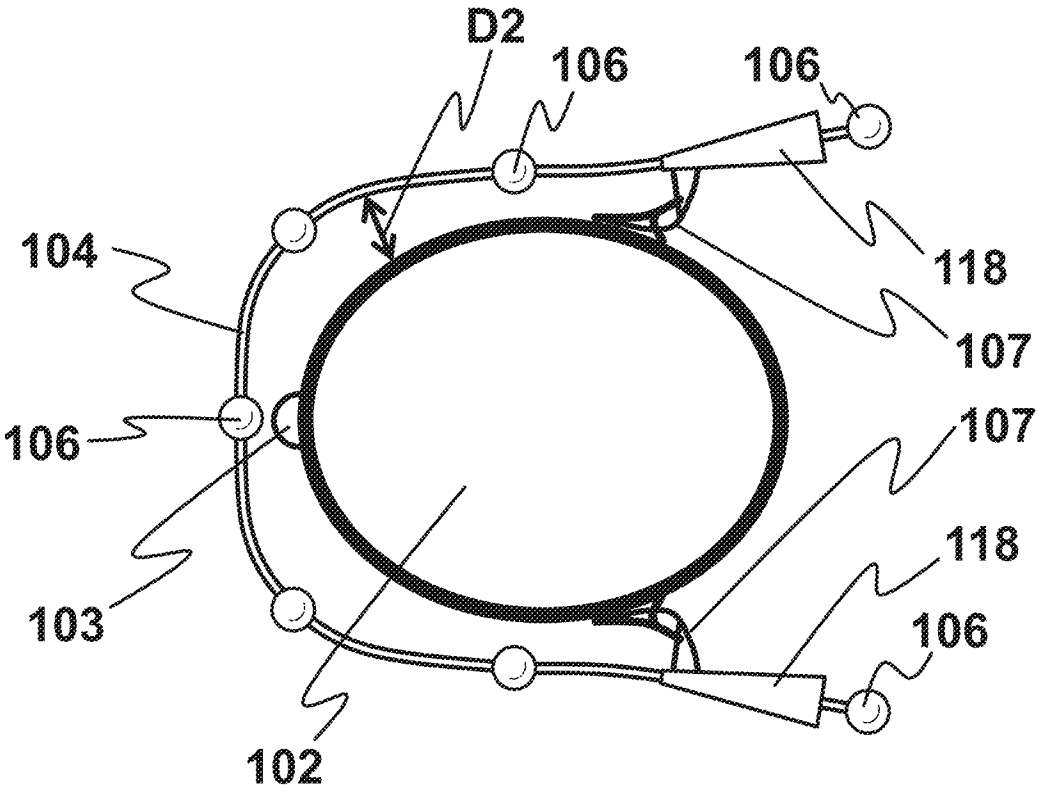
FIG. 4 shows a top view of an embodiment of a positioning device mounted on a human head.

FIG. 4 shows a top view of the head of user 102 including the end of the nose 103 of user 102 to ensure there is no confusion in understanding of the view shown. Positioning device 104 is shown with positioning interfaces 106, housings 118, and ear supports 107. Housings 118 may contain batteries, electronics, interfaces, and other elements beneficial to the operation of positioning device 104. Head-to-headset distance D2 shows that a separating distance is substantially maintained between the head of user 102 and the tube forming positioning device 104. Sensors mounted on mounting posts such as sensors 312 in FIGS. 3A-3C may catch or be obstructed by elements on positioning device 104. As such, embodiments of hair cutting devices having sensors mounted similarly to sensors 312 may benefit if cutter head-to-sensor distance D as shown in FIG. 3B is greater than head-to-headset distance D2 such that the sensors on the hair cutting device would be somewhat further away from the head of user 102 than a tube or other element of a positioning device during substantially normal operation of automated hair cutting system 100, thereby reducing interference with a tube or other element of the positioning device. In some embodiments, the sensors may be mounted at different heights relative to one another. Those skilled in the art will recognize that a wide range of positioning devices and hair cutting devices are possible, so a wide array of mechanical constructions are possible to benefit their use in a convenient manner.

Figure 5:
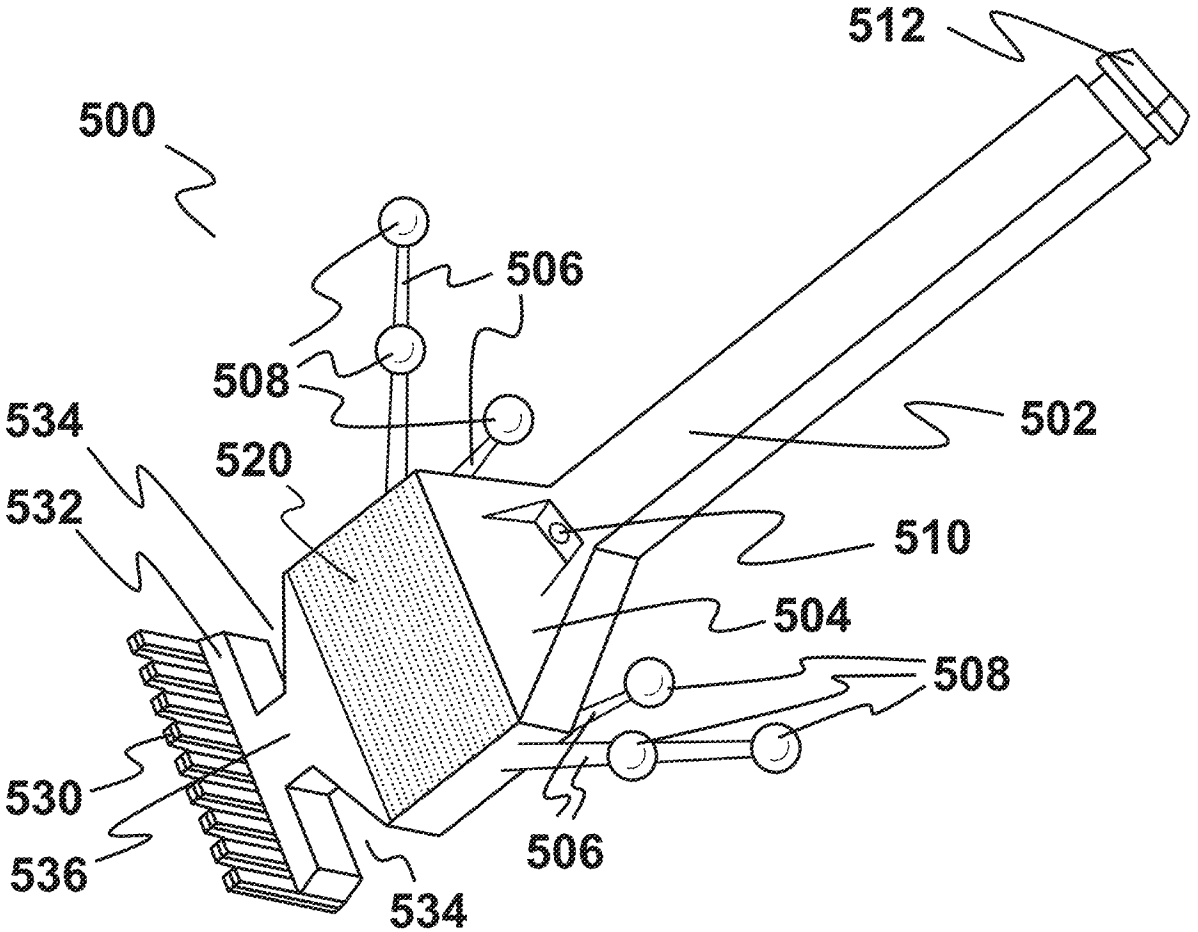
FIG. 5 shows a perspective view of another embodiment of a hair cutting device according to the present disclosure.

Referring now to FIG. 5, there is shown hair cutting device 500 comprising another embodiment according to the present disclosure. Hair cutting device 500 includes cutter head 530 that may that may be of similar construction to cutter heads shown in this disclosure or may have other construction. Cutter head 530 is mounted to cutter head base 532. Cutter head base 532 adjoins center body 536. Center body 536 adjoins main body 504. Main body 504 may contain an actuator to actuate cutter head 530. An actuator inside main body 504 may be a solenoid, voice coil motor, stepper motor, linear actuator, rotary actuator, or other possible type of actuator and motion from the actuator may be transferred to cutter head 530 through mechanical connections inside main body 504, center body 536, and cutter head base 532. These mechanical connections may include levers, bearings, gears, axles, hubs, cams, or other possible mechanical functions. The construction of cutter head 530, cutter head base 532, center body 536, and main body 504 as shown in FIG. 5 may be beneficial for some embodiments as relief areas 534 on each side of center body 536 and between main body 504 and cutter head base 532 may allow a user to more easily maneuver cutter head 530 around ears and other facial features to more easily achieve beneficial results with an automated hair cutting system 100 than may otherwise be possible.

Some embodiments of hair cutting device 500 may incorporate a center body 536 that allows cutter head base 532 and cutter head 530 to pivot or articulate relative to main body 504. A cutter head base 532 and cutter head 530 that may pivot or articulate may enable cutter head 530 to be more easily maneuvered over the scalp of a user receiving a haircut and potentially make it easier to collect hair in cutter head 530. Those skilled in the art will recognize that actuators, motors, or other elements for driving cutter head 530 may need to be designed to accommodate pivoting or articulation of cutter head 530 and cutter head base 532. And in some embodiments, it may also be beneficial to incorporate sensors to substantially sense the pivot angle of cutter head 530 relative to main body 504 so that errors that may otherwise occur in computing the positioning and/or orientation of cutter head 530 based on analysis of signals from sensors 508 (and/or from other or additional techniques that may be used for determining position and/or orientation) may be substantially compensated for.

Hair cutting device 500 includes sensors 508 mounted on sensor posts 506. These sensors 508 perform substantially similar functions to the sensors 312 shown on hair cutting device 300 and in other possible hair cutting devices for automated hair cutting systems 100. Mounting sensors 508 on sensor posts 506 may improve the ability of sensors 508 to receive signals (and in some embodiments, to send signals), as sensors 508 on sensor posts 506 are less likely to be blocked by other parts of hair cutting device 500 or by the hand of a person holding it. Six sensors 508 are shown mounted on four sensor posts 506 in FIG. 5, but those skilled in the art will recognize that a wide range of numbers of sensors 508 on a wide range of numbers of sensor posts 506 are possible. The configuration and locations of sensors 508 on sensor posts 506 of the embodiment of hair cutting device 500 provides benefit in that the sensor posts 506 extend from or near to the sides of main body 504 so that the top and bottom of main body 504 are mostly available for a person holding hair cutting device 500 to easily grip and maneuver it. For reference, the sides of main body 504 as shown in FIG. 5 are parallel to the comb teeth of cutter head 530 and the top and bottom of main body 504 are parallel to the line in which cutter head 530 is actuated. Other configurations of sensor posts 506 and sensors 508 are possible. Those skilled in the art will recognize that additional sensors 508 may be placed on hair cutting device 500 on main body 504, on center body 536, on cutter head base 532, on handle 502, or possibly on other locations on hair cutting device 500. It is also noted that sensor posts 506 may be contoured or faceted at their base and possibly along their length to benefit the smooth flow of hair over them and to avoid snagging. Sensor posts 506 may be fabricated from plastics, metals, or other materials. Main body 504, handle 502, center body 536, and cutter head base 532 may be formed from aluminum, other metals, plastics, combinations of materials, or other materials.

Hair cutting device 500 includes anti-reflection surface 520 on the top surface of main body 504. Anti-reflection surface 520 may be a corrugation, texture, or finish formed or generated in the course of fabrication of main body 504; or may be a paint, coating, lamination, or other possible finishing layer applied after main body 504 has been formed. Hence, anti-reflection coating 520 may be generated, formed, applied, affixed, or created in many possible fashions. Anti-reflection surface 520 may be of a material, texture, or finish to reduce the likelihood of reflections of the signals that may be used in an automated hair cutting system 100 so that reflecting signals are less likely to generate interference at sensors 508. For example, if sound or ultrasonic signals are used, anti-reflection coating may be a soft material such as leather, rubber, soft plastics, or other materials that may substantially absorb sound waves and substantially not reflect them. As another example, if light signals are used in an automated hair cutting system, flat black paint or coatings may be applied as an anti-reflection surface to reduce reflections. Anti-reflection surfaces 520 may be applied to hair cutting device 500 on all beneficial surfaces and not only on the top of main body 504 as shown in FIG. 5. Also, anti-reflection surfaces 520 may be selected, for some embodiments, to also benefit the ability or comfort of a user in holding and maneuvering hair cutting device 500.

Hair cutting device 500 includes camera 510, handle 502, and button 512. Handle 502 as shown in FIG. 5 is a long handle that may allow hair cutting device 500 to be easily maneuvered in the fashion that a painter may maneuver a paint brush. Handle 502 in FIG. 5 is shown extending axially from main body 504 in a direction opposite of center body 536, but some embodiments may adopt handles extending to the side or in other directions. Camera 510 may be used in support of determining position and/or orientation of hair cutting device 500 and may also be used to allow user 102 to observe their hair on electronic computing device 108 (that is, images or video from camera 510 may be displayed on electronic computing device 108) to aid in the ability of user 102 to maneuver and apply hair cutting device 500 and to observe their hair.

Button 512 may allow a user 102 to send a variety of signals to hair cutting device 500 including signaling to automated hair cutting system 100 that a reference point has been touched (see Krenik '856 for information on reference points), that actuation of cutter head 530 should cease due to safety concerns, that hair has been collected in cutter head 530 and extension of hair may begin, or other beneficial signals. Button 512 may have varying functionality and be used for different purposes at different times in the course of operation of an automated hair cutting system 100. Additional buttons, touch sensitive regions, switches, electrical knobs, or other ways to allow a user to control hair cutting device 500 may be added to center body 536, main body 504, or handle 502 in various possible embodiments.

Figure 6:
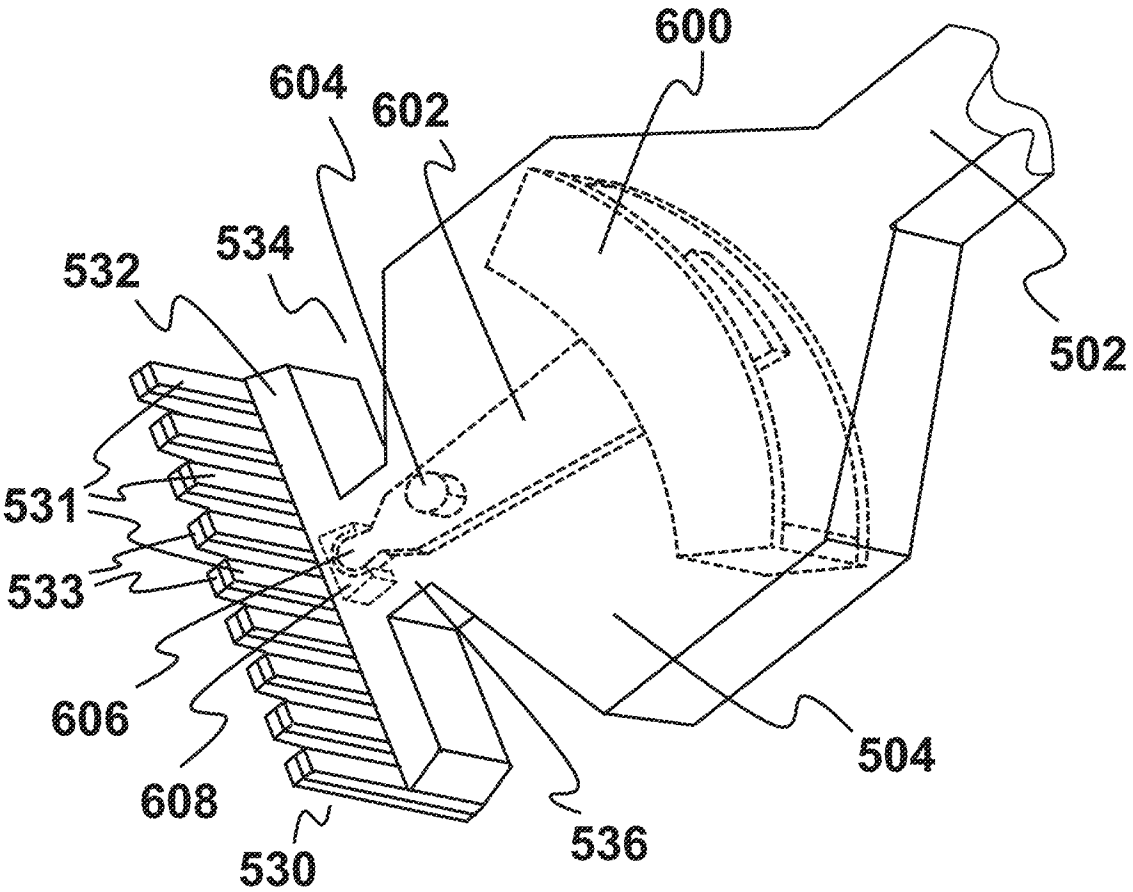
FIG. 6 shows a perspective internal view of a portion of a hair cutting device similar to the embodiment of FIG. 5.

FIG. 6 shows a perspective internal view of a portion of a hair cutting device similar to the embodiment of FIG. 5 and shows how a rotary actuator may be used to actuate a cutter head of such a hair cutting device. Numbered elements in FIG. 6 perform the same functions as like numbered elements in FIG. 5. Lever 602 is driven by actuator 600 on axle 604 to drive rounded end 606 in hub 608. Hub 608 may be mechanically connected to cutter knives 531 so that motion generated by actuator 600 is transferred to cutter knives 531 so that they may be actuated relative to comb teeth 533 of cutter head 530. Those skilled in the art will recognize that actuator 600 may be a rotary voice coil motor actuator such as those found commonly in hard disk drives and other equipment. Actuator 600 may contain permanent magnets, electro-magnets, and other beneficial elements. Lever 602 may comprise a coil of wire interactive with magnets contained in actuator 600 to effect torque on lever 602 when such a coil is energized with electrical current. Axle 604 may be supported by ball bearings or other suitable forms of bearings. Those skilled in the art will recognize that actuator 600, lever 602, axle 604, rounded end 606, and hub 608 may be fabricated from suitable materials including suitable combinations of magnetic iron, magnetic metals, aluminum, steel, other metals, plastics, and/or other suitable materials.

Figure 7:
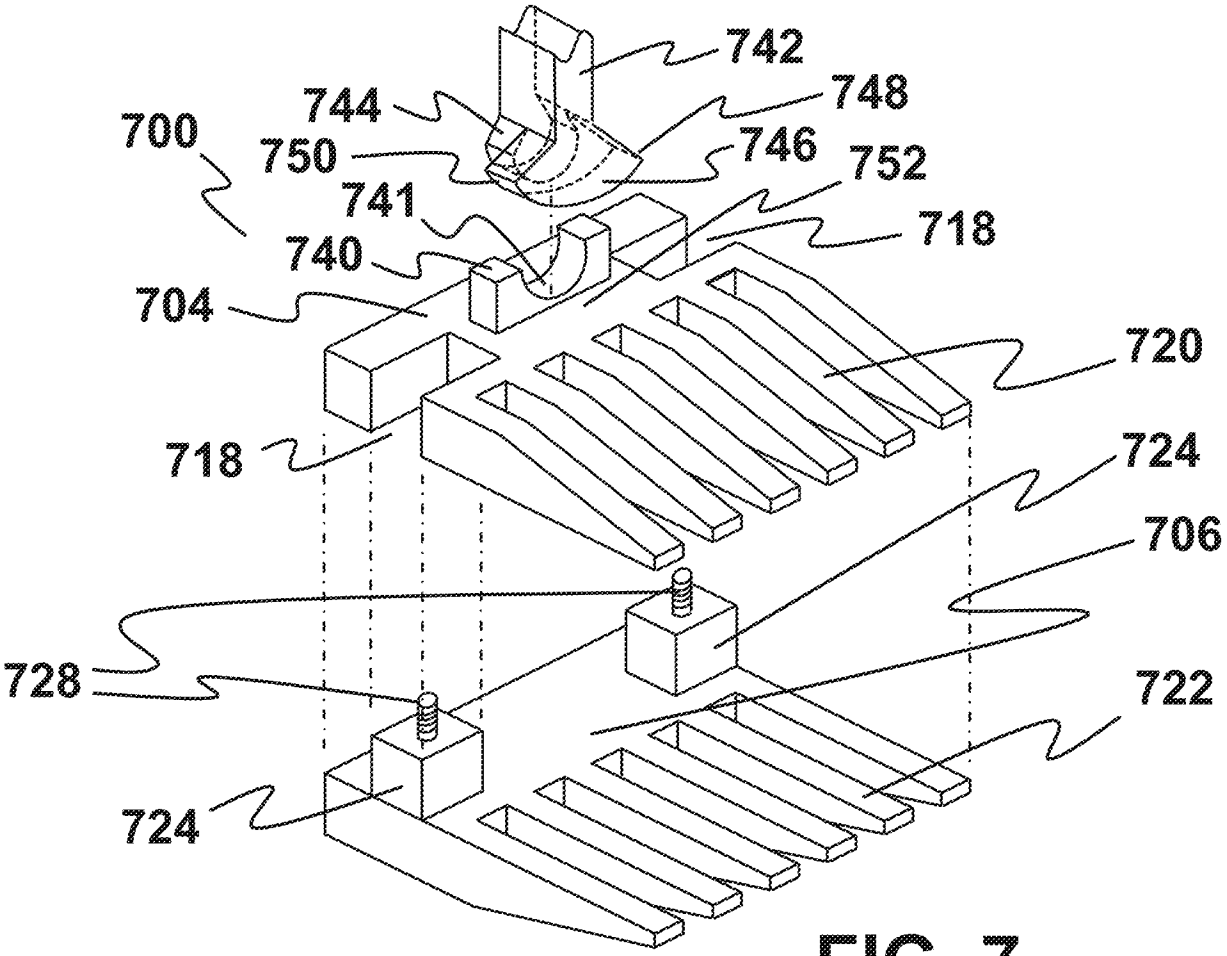
FIG. 7 shows an exploded view of one embodiment of a cutter head according to the present disclosure.

FIG. 7 shows an exploded view of a cutter head 700 that includes elements suitable for use in a hair cutting device such as hair cutting device 300, hair cutting device 500 or other possible hair cutting devices. Cutter head 700 comprises a bottom comb 706 including comb teeth 722, mounting standoffs 724, and mounting screws 728. Cutter head 700 also comprises top cutter 704 including cutter knives 720, guide openings 718, top surface 752, and hub 740. When cutter head 700 is utilized on a hair cutting device such as hair cutting device 500, mounting screws 728 may affix bottom comb 706 to cutter head base 532 and mounting standoffs 724 may engage guide openings 718 so that lateral force on hub 740 provides guided actuation of top cutter 704 relative to bottom comb 706. Cutter head 700 may be utilized in multiple ways to collect, extend, and/or cut hair in the course of operation of an automated hair cutting system 100. Cutter knives 720 and comb teeth 722 may be constructed in the fashion of cutter knives 204 and comb teeth 202 of cutter head 200 shown in FIG. 2 in some embodiments, or may be of other construction (see Krenik '201 for additional possible embodiments of cutter knives and comb teeth).

Lever 742 may perform similar functions to lever 602 in FIG. 6 or may be of another possible lever design for actuating a cutter head of various possible embodiments of hair cutting devices. Lever 742 includes rounded end 744 that may engaged rounded opening 741 of hub 740 so that actuation of lever 742 may transfer to lateral motion of hub 740, and so, to lateral motion of top cutter 704. Lever 742 also comprises cam 746 that has shorter radius near left cam end 750 and longer radius near right cam end 748. In operation, cam 746 engages top surface 752 of top cutter 704 and provides pressure on top surface 752 to compress top cutter 704 against bottom comb 706 so that cutter knives 720 may intimately engage comb teeth 722. Those skilled in the art will recognize that rotary actuation of lever 742 over an axle (no axle is shown in FIG. 7, but an axle such as axle 604 of FIG. 6 or other possible axle or pivot may be used in various embodiments) may result in cam 746 providing various levels of pressure against top surface 752 as a function of the rotary position of lever 742 (due to the difference in radius of cam 746 near left cam end 750 and right cam end 748). Cam 746 may be configured for various embodiments to provide substantially constant pressure on top surface 752 (in which case it may have substantially consistent radius from left cam end 750 to right cam end 748) or may be configured to provide a variety of levels of pressure on top surface 752 as a function of the rotary position of lever 742. Some embodiments may benefit from substantially higher levels of pressure from cam 746 on top surface 752 when cutter knives 720 are engaging comb teeth 722 for cutting action and substantially lower levels of pressure from cam 746 on top surface 752 during hair collection and extension (so that friction between top cutter 704 and bottom com 706 is reduced during hair collection and extension). Cam 746 may be formed from the same materials as lever 742 and rounded end 744 or may be formed from other materials and be attached or affixed to lever 742. Some embodiments of cam 746 may benefit from use of compliant materials (such as rubber, plastics, or other compliant materials) that may partially compress under pressure. Compliant materials may also be used to benefit on top surface 752 where compliant materials may be inlaid, embedded, laminated, or otherwise applied for beneficial effect. Those skilled in the art will recognize that a wide range of possible levers, cams, hubs, top cutter constructions, bottom comb constructions, axles, bearings, hard materials, compliant materials, and other materials and constructions may be used to drive a cutter head for a hair cutting device.

Figure 8:
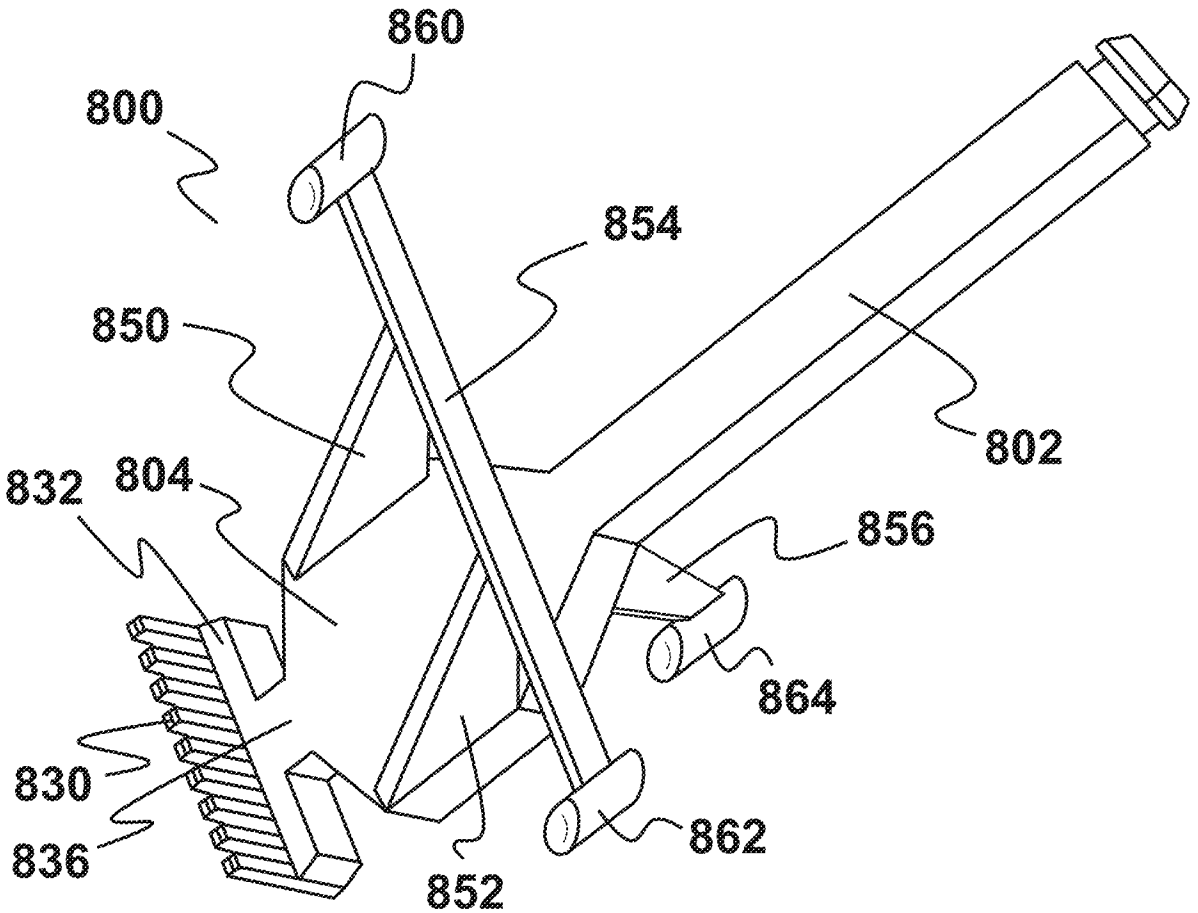
FIG. 8 shows a perspective view of another embodiment of a hair cutting device according to the present disclosure.

FIG. 8 is a perspective view of an embodiment of a hair cutting device 800 having sensors mounted on supports around a central structure and with a straight handle extending axially from the central structure. Hair cutting device 800 comprises cutter head 830, cutter head base 832, center body 836, main body 804, handle 802, left top support 850, right top support 852, lateral support 854, left sensor 860, right sensor 862, bottom support 856, and bottom sensor 864. Left sensor 860, right sensor 862, and bottom sensor 864 may comprise various configurations and structures, similar to sensors 312 as shown in FIG. 3A and discussed in conjunction herein. Left sensor 860, right sensor 862, and bottom sensor 864 are shown in FIG. 8 directed in parallel to handle 802 and toward the direction of cutter head 830, but may be configured in other directions for some embodiments. The embodiment of hair cutting device 800 in FIG. 8 utilizes left top support 850 and right top support 852 affixed to main body 804 near the sides of main body 804 and mounted so that the width of main body 804 is not substantially increased so that the resulting width of main body 804, left top support 850 and right top support 852 is not substantially more than the width of cutter head 830 (however, main body 804 may be sized in various configurations and sizes relative to cutter head 830). Accordingly, hair cutting device 800 is configured so that its overall main body 804 width is kept substantially similar to or smaller than the width of cutter head 830 so that it may be more easily maneuvered around a positioning device (such as positioning device 104) in the course of providing a haircut. Lateral support 854 is attached to left top support 850 and right top support 852 and supports left sensor 860 and right sensor 862 to be substantially above and wider than main body 804. Bottom support 856 supports bottom sensor 864 to be below and relatively near to main body 804 (relatively near to main body 804 relative to the distance that left sensor 860 and right sensor 862 are above main body 804).

The location of sensors of hair cutting device 800 relative to main body 804 as shown in FIG. 8 may offer benefit from some embodiments. Referring to FIG. 1, as hair cutting device 300 is maneuvered to collect, extend and cut hair along the sides, front, and back of the head of user 102, the teeth of cutter head 302 may generally point in a substantially upward direction so that hair cutting device 300 may generally have elements of positioning device 104 at close proximity to the side of hair cutting device 300 substantially opposite the direction that the teeth of cutter head 300 are pointing. Hence, hair cutting devices such as hair cutting device 800 may have sensors mounted further apart and away from the main body 804 of hair cutting device 800 on the side of hair cutting device 800 from which the teeth of cutter head 830 emanate and point away from, since sensors mounted apart from the main body 804 of a hair cutting device 800 in the direction the cutter head 830 teeth are pointing are less likely to interfere with a positioning device 104. Further, locating sensors substantially separated from each other and from the main body 804 of a hair cutting device 800 may facilitate a plurality of different positioning signals produced by positioning interfaces 106 that are further separated from each other on a positioning device 104 (providing benefits for reliable computation of the position and/or orientation of a hair cutting device relative to the head of a user). Sensors that are located on a side of a hair cutting device 800 opposite to the direction the teeth of a cutter head are pointing may be kept substantially closer to the central body of such a hair cutting device so that they are less likely to mechanically interfere with a positioning device 104 in the course of operation of an automated hair cutting system 100. It is also noted that sensors that are located on a side of a hair cutting device opposite to the direction the teeth of a cutter head are pointing may be mounted further back from cutter head 830 than the head-to-headset distance D2 (as shown in FIG. 4), or other suitable dimension for clearance that may be appropriate for various embodiments of positioning devices. Only three sensors are shown in FIG. 8, but additional sensors may be mounted on lateral support 854 and additional sensor mounts and sensors may also be mounted on the bottom of main body 804 (in addition to bottom sensor 864). Those skilled in the art will recognize that a wide range of sensor supports, sensor locations, shapes of sensor supports, and other configurations of sensors are possible that adhere to the beneficial configuration demonstrated by the embodiment of hair cutting device 800 that utilizes sensors further from a main body 804 to the side of a hair cutting device that cutter head teeth are pointing and closer to a main body 804 on the side opposite that in which cutter head teeth are pointing.

Figure 9:
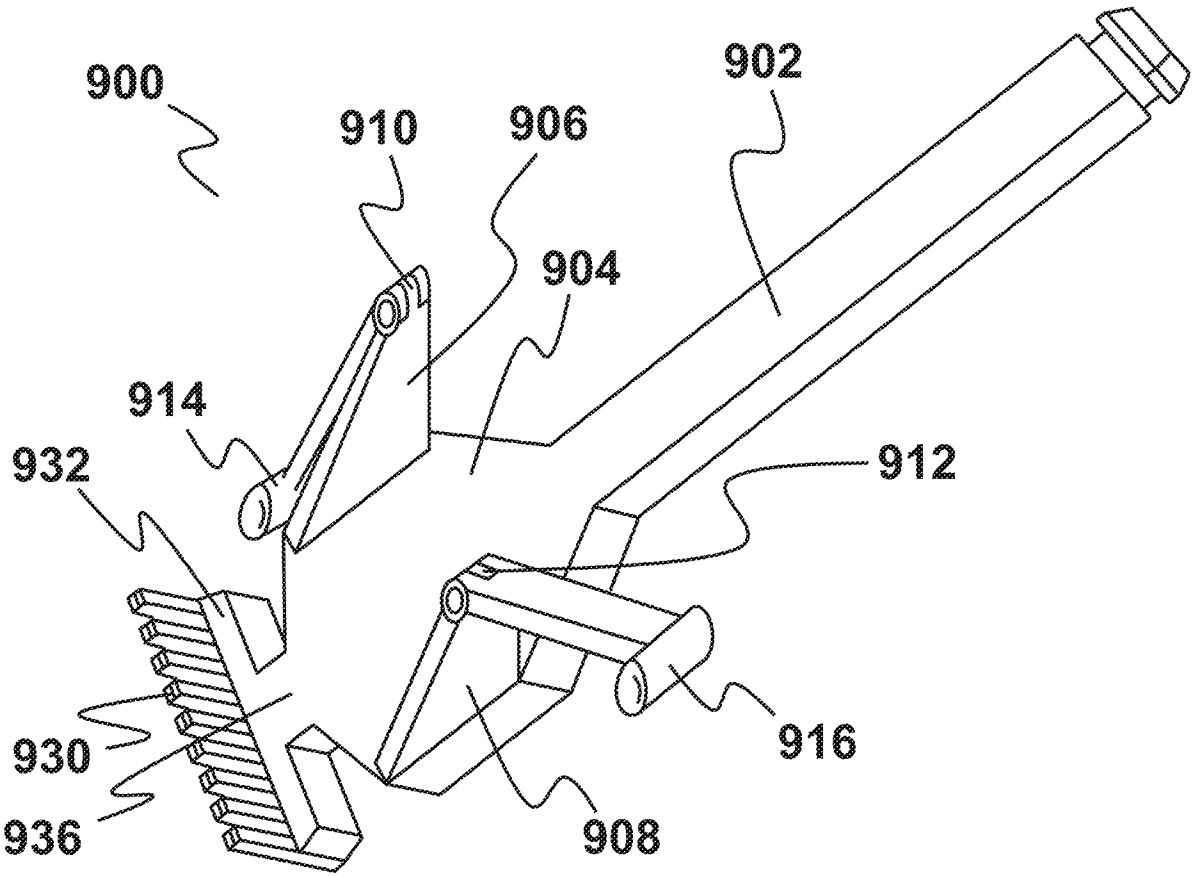
FIG. 9 shows a perspective view of yet another embodiment of a hair cutting device according to the present disclosure.

FIG. 9 shows a perspective view of an embodiment of a hair cutting device 900 having another configuration of sensors. Cutting device 900 comprises cutter head 930, cutter head base 932, center body 936, main body 904, handle 902, left support 906, right support 908, left sensor 914, right sensor 916, left hinge 910, and right hinge 912. Left hinge 910 in left support 906 is shown folded so that left sensor 914 is substantially close to main body 904 for compact storage. Right hinge 912 in right support 908 is shown folded so that right sensor 916 is extended for operation. Those skilled in the art will recognize that various embodiments of sensors, sensor supports, sensor posts, and other structures used to support sensors on hair cutting devices may include the use of hinges, telescoping structures, pivots, collapsible structures, retractable structures, and other suitable structures that may allow sensors to be positioned for operation and also moved to alternative positions for compact or otherwise beneficial positions for storage. In addition, some embodiments of hair cutting devices may utilize support structures for sensors that may be positioned for some hair cutting operations and repositioned to other locations for other hair cutting operations. That is, some sensors on a hair cutting device may be re-positioned in the course of operation of an automated hair cutting system to benefit operation or to avoid interference with a positioning device or user. For such embodiments, the substantially precise location of sensors relative to the body and cutter head of a hair cutting device may be calibrated automatically based on measurements to fixed points on the body or to other sensors, entered manually by a user into an automated hair cutting system (for example, one of perhaps only a few possible positions for a given sensor might be manually entered into electronic computing device 108), determined through the use of encoders or other automated elements present in the various hinges or other structures used to support and position sensors, or through other possible techniques. The embodiment of hair cutting device 900 shown includes only two sensors, but those skilled in the art will recognize that additional embodiments with other numbers of sensors are possible.

Figure 10:
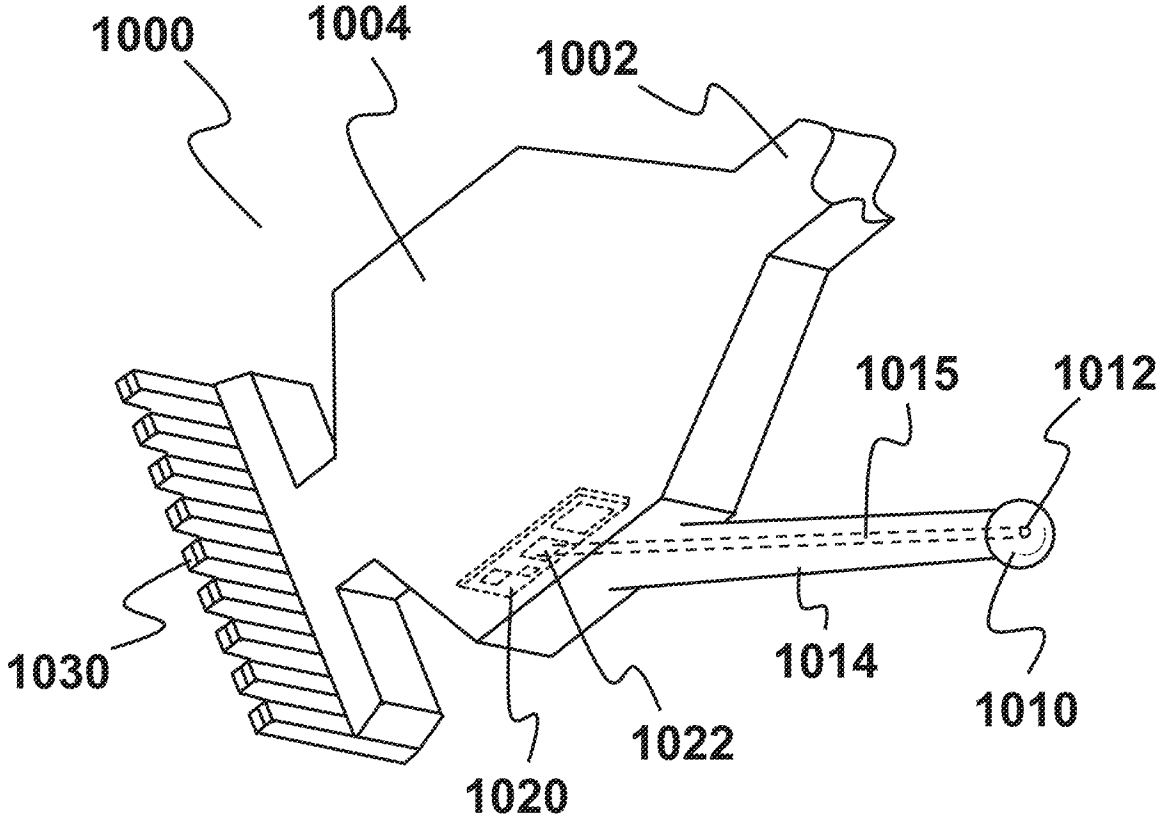
FIG. 10 shows a detailed perspective view of one aspect of a hair cutting device according to the present disclosure.

FIG. 10 shows a partial view of a hair cutting device 1000 having yet another sensor configuration. Cutting device 1000 comprises cutter head 1030, main body 1004, handle 1002 (only partially shown in the figure), sensor 1010, sensor opening 1012, sensor post 1014, acoustic pathway 1015, circuit board 1020, and microphone 1022. Hair cutting device 1000 provides an example of a sensor post 1014 that includes a hollow center, tube, tunnel, or other formation to create an acoustic pathway 1015 from an opening 1012 in sensor 1010. The embodiment of hair cutting device 1000 allows an acoustic positioning signal to be channeled from the location of sensor 1010 through sensor opening 1012 and acoustic pathway 1015 to a microphone 1022 mounted on a circuit board 1020 inside main body 1004. Locating microphone 1022 inside main body 1004, may eliminate the need for electrical connections through sensor post 1014 to sensor 1010. Use of an acoustic pathway 1015 inside sensor posts on a hair cutting device may allow embodiments of automated hair cutting systems using audible sound, ultrasound, or other acoustic positioning signals to be more easily manufactured. Those skilled in the art will recognize that similar embodiments using waveguides, optical pathways, or other structures that allow positioning signals to be directed to a sensing device inside main body 1004 or other element of a hair cutting device may provide similar benefits for other types of positioning signals. Those skilled in the art will also recognize that compensation of the propagation time of a signal through acoustic pathway 1015 (or other structure to allow directed signal propagation) may be done in conventional ways in the course of computation of position and/or orientation of a hair cutting device as the dimensions of acoustic pathway 1015 and the propagation characteristics of signals through acoustic pathway 1015 may be known. In some embodiments, sensor opening 1012 may be protected with a grill, mesh, filter, or other structure to reduce the likelihood that dirt, cut hair, or other contaminants may obstruct sensor opening 1012.

Figure 11:
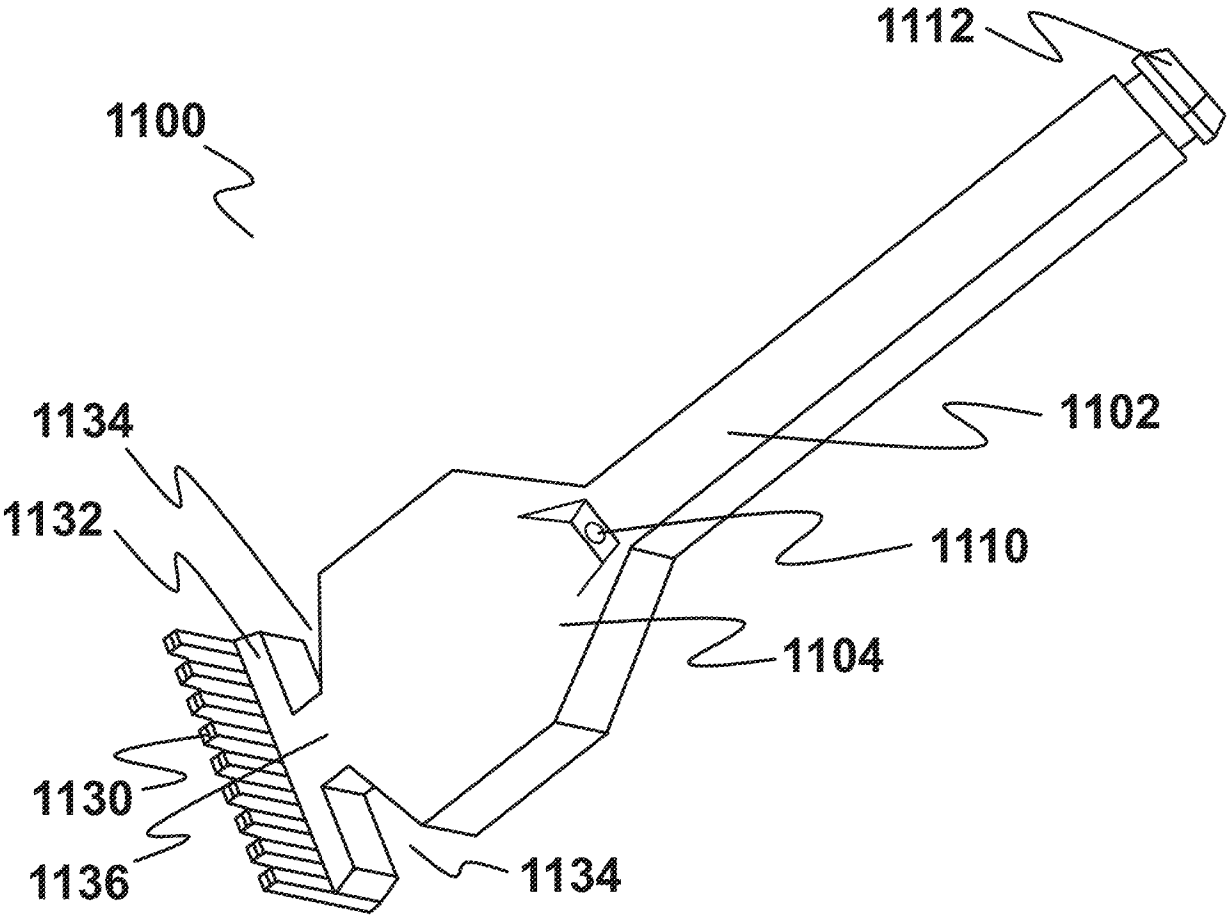
FIG. 11 shows a perspective view of yet another embodiment of a hair cutting device according to the present disclosure.

FIG. 11 shows an embodiment of a manual hair cutting device 1100 that does not make use of position sensors or other automated functions. Manual hair cutting device 1100 comprises cutter head 1130, cutter head base 1132, center body 1136, main body 1104, handle 1102, camera 1110, relief areas 1134 and button 1112. Some embodiments of manual hair cutting device 1100 may not include sensors or sensor posts. Manual hair cutting device 1100 may be designed to be used manually, so cutter head 1130 may be actuated due to a voice command, button press of button 1112 (or other buttons that may be added to an embodiment in FIG. 11), or other manual signal from a person using manual hair cutting device 1100. A camera 1110 may be included on manual hair cutting device 1100 as some embodiments of manual hair cutting device 1100 may include a wired or wireless link to an electronic display or electronic computing device (such as electronic computing device 108 shown in FIG. 1) so that images and/or video from camera 1110 may be displayed and viewed as a user is cutting their hair. It is also noted that hair cutting devices for automated hair cutting system 100 (such as hair cutting device 500 of FIG. 5) may also be used, at times, in a manual mode in the fashion of hair cutting device 1100 of FIG. 11. That is, while hair cutting device 500 includes elements for operation in an automated hair cutting system 100, manual modes of operation may also be possible for some embodiments and either manual or automated operation may be preferred for some hair cutting operations, user preferences, or other considerations.

Figure 12:
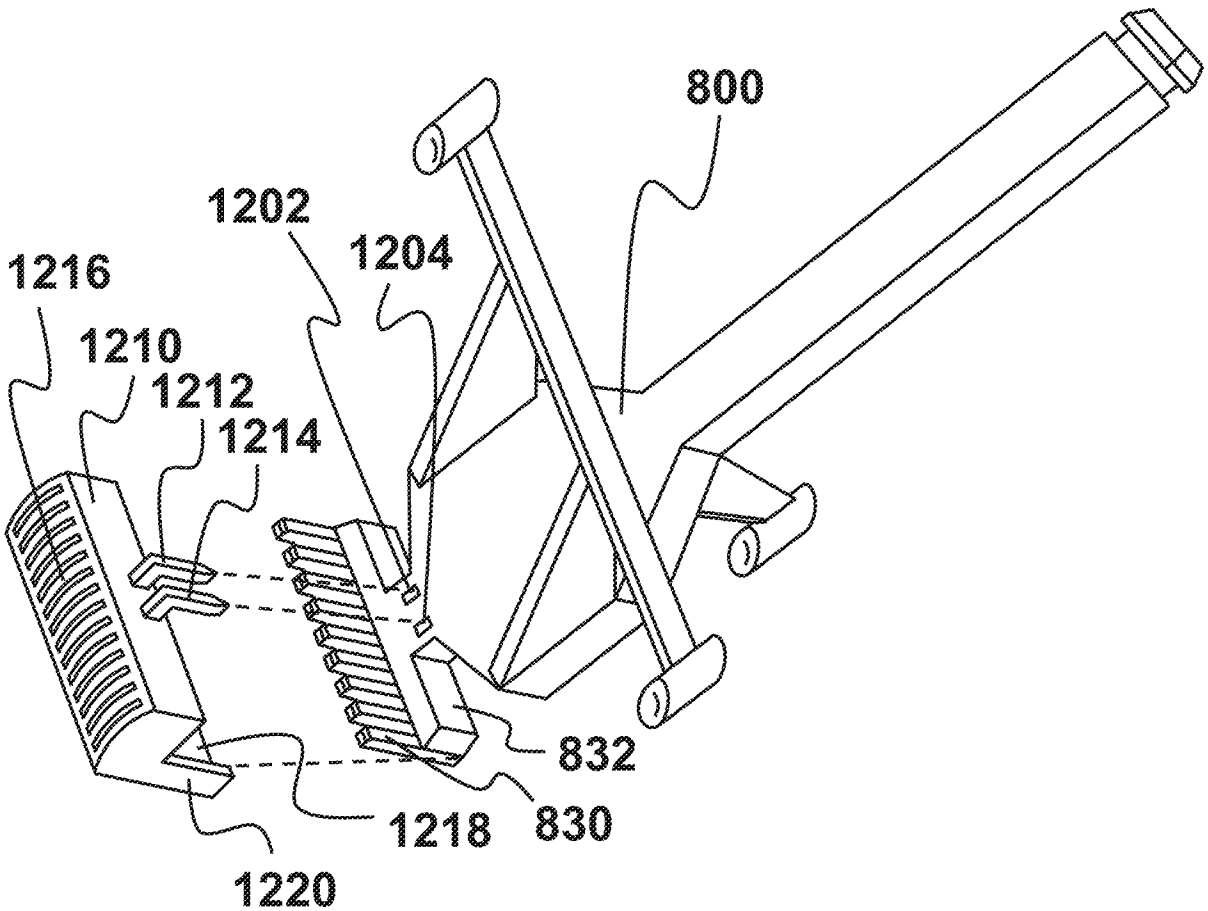
FIG. 12 shows an exploded view of another aspect of a hair cutting device according to the present disclosure.

FIG. 12 shows an exploded view of a shaving accessory 1210 and hair cutting device 800. The embodiment of hair cutting device 800 shown in FIG. 12 includes a first electrical plug 1202 and a second electrical plug 1204. First electrical plug 1202 and a second electrical plug 1204 may provide access to electrical power for shaving accessory 1210 when first electrical lead 1212 and second electrical lead 1214 are mated to first electrical plug 1202 and second electrical plug 1204, respectively, when shaving accessory 1210 is mounted to hair cutting device 800. Power provided by first electrical plug 1202 and second electrical plug 1204 to shaving accessory may include power and ground sources, power and common, DC (direct current) power and ground, positive and negative DC power sources, AC (alternating current) and ground, multiple phases of AC power, or any other configuration of power, ground, and other possible power sources suitable for powering an accessory. While the embodiment of FIG. 12 shows only a first electrical plug 1202 and a second electrical plug 1204, those skilled in the art will recognize that embodiments including additional electrical plugs and leads are possible. Embodiments with only one electrical plug and electrical lead may also be provided if a ground connection (or other secondary electrical connection) may be established through other mating conductive surfaces when shaving accessory 1210 is mounted to hair cutting device 800. Those skilled in the art will recognize that in addition to providing power, electrical connections through plugs and leads may be established between shaving accessory 1210 and hair cutting device 800 that allow hair cutting device 800 to control shaving accessory 1210. Such controls may include turning on and off or controlling the speed of a motor or motors inside shaving accessory 1210 or providing other beneficial control signals. Shaving accessory 1210 may also provide information or controls to hair cutting device 800 such as indications of over-heating of a motor inside shaving accessory 1210, indications of fault conditions, indications of motor speed, or other useful information. And while the embodiment of FIG. 12 shows conductive electrical connections between shaving accessory 1210 and hair cutting device 800, those skilled in the art will recognize that inductive connections through magnetic coils, wireless interfaces, or other suitable techniques may be utilized to transfer power and signals between a hair cutting device and a shaving accessory.

Shaving accessory 1210 may contact the base of cutter head 830 and may also contact other portions of cutter head 830 and cutter head base 832. Inside surface 1218 of shaving accessory 1210, for example, may contact cutter head 830 and side panel 1220 of shaving accessory 1210 may contact the side of cutter head 830 and/or cutter head base 832. Hair cutting device 800 may sense when shaving accessory 1210 is attached (through sensing and analysis of the electrical connections already explained or use of other sensors, switches, proximity sensors, or other techniques) and may inactivate cutter head 830 so that shaving accessory 1210 may contact cutter head 830 without concern regarding actuation of the cutter knives of cutter head 830. Shaving accessory 1210 may contain one or more electric motors or actuators to drive one or more blades behind shaving screen 1216. Hairs may enter the openings of shaving screen 1216 and extend inside shaving accessory 1210 so that moving blades may cut them (in a manner well-established by the many electric shavers now commonly available). Shaving accessory may be mechanically attached to hair cutting device 800 with clips, pins, screws, cams, Velcro, magnets, snaps, or other suitable techniques. In addition to attaching to a cutter head as shown in FIG. 12, shaving accessories or other accessories may be attached to a hair cutting device at other locations or in other configurations.

The embodiment of a shaving accessory 1210 mounted to a hair cutting device 800 as shown in FIG. 12 may allow the positioning and control benefits of an automated hair cutting system 100 to be extended to shaving and may allow a battery or other power source in a hair cutting device 800 to be utilized to power a shaving accessory. Those skilled in the art will recognize that additional accessories for other purposes besides shaving may benefit from similar application to the embodiment of FIG. 12. Accessories used for the purpose of trimming, shaving, thinning, texturing, detailing, or otherwise cutting or styling hair may be applied to a hair cutting device 800 in the manner shown in FIG. 12. Accessories used for purposes besides cutting, shaving, or trimming hair may also be applied to hair cutting devices. For example, make-up applicators, face paint applicators, lipstick applicators, facial massagers, cosmetics applicators, eye make-up applicators, hair dye applicators, curling irons, hair shaping/styling accessories, and many other possible accessories may benefit from the ability to attach to and be powered and controlled by a hair cutting device in an automated hair cutting system. Those skilled in the art will recognize that unpowered accessories may also be attached to a hair cutting device so that they may also benefit from the position and/or orientation sensing and control capability of an automated hair cutting system. Examples of such unpowered accessories include safety razors, straight razors, unpowered face paint or makeup applicators, unpowered hair dye or hair highlights applicators, or other possible accessories.

Position sensors, cameras, transducers, or other elements for generating or sensing positioning signals on a hair cutting device may be mounted in improved locations that allow persons using an automated hair cutting system more options for how to hold and maneuver a hair cutting device. Such improved locations and mounts may also allow position sensors, cameras, transducers, or other elements for generating or sensing positioning signals to be substantially less likely to be blocked so that they are more effective in providing signals that may be used to determine the position and/or orientation of a hair cutting device. Mounting posts and structures may be contoured so they are less likely to snag hair. Hair cutting devices may have sensor supporting structures that are larger so that sensors may be more broadly spaced on the side of a hair cutting device from which cutter head teeth emanate and point away from, and sensor supporting structures that are smaller so that they interfere less with a positioning device on the side of the hair cutting device opposite the direction that cutter head teeth point. Improved balance of hair cutting devices may improve user comfort and maneuverability. Improved balance may be achieved by preferred location of batteries, electronics, and other internal elements of a hair cutting device, and may also include use of ballast weights.

Hair cutting devices may better interoperate with specific positioning devices and may have physical dimensions and placement of sensors and supporting structures that are configured to minimize undesired interference. Hair cutting devices may include relief areas between a cutter head supporting structure and a main body so that a cutter head may be more easily manipulated around ears and other features of a user's head. Actuators and cutter head drive mechanisms may be designed to allow such relief areas and may provide variable forces on cutter heads to reduce friction and power levels used during some phases of cutter head operation and provide reliable cutting action in other phases of cutter head operation. Structures supporting sensors on hair cutting devices may be folded for compact storage or may be adjusted in the course of operation. Structures supporting sensors may provide passive channels or guides so that positioning signals may propagate around or inside a supporting structure to sensing electronics located some distance from the point where a positioning signal is actually sensed. And electrically powered or unpowered accessories, such as a shaving accessory, may be mounted to and possibly be powered and/or controlled by a hair cutting device.

Although the present disclosure has been described in detail, those skilled in the pertinent art should understand that they can make various changes, substitutions and alterations herein without departing from the spirit and scope of the disclosure in its broadest form.

The invention claimed is:

1. A cutting device for use with an automated hair cutting system for cutting hair on a user's head, the automated hair cutting system comprising a positioning apparatus having at least one positioning interface supported thereon, the cutting device comprising:

a body having a proximal end and a distal end;

a cutter head attached to the distal end of the body, the cutter head configured for manipulating and cutting hair; and at least one sensor coupled to the body, the at least one sensor configured to either send signals to or receive signals from at least a subset of the at least one positioning interface, and wherein, during operation of the automated hair cutting system, the signals are employable to at least partially determine a plurality of positions of the cutter head relative to the user's head including locations of varying distances from a surface of the user's head as said cutting device is articulated about said user's head;

the cutting device is configured to employ a plurality of cutting actions by said cutter head that are initiated by said automated hair cutting system, said cutting actions employable to cut hair to a plurality of lengths, each of said plurality of cutting actions initiated at least partially responsive to the positions of the cutter head relative to the user's head.

2. The cutting device according to claim 1, wherein the cutting device is configured to communicate with a computing device.

3. The cutting device according to claim 1, wherein the body comprises at least a first section and a second section, wherein the cutter head is coupled to the first section and the second section comprises a handle at the proximal end of the body.

4. The cutting device according to claim 3, wherein the first section comprises at least an actuating member, wherein the actuating member comprise mechanical elements configured to drive the cutter head coupled to the distal end thereof.

5. The cutting device according to claim 4, wherein the first section further comprises a main member, wherein the main member comprises electronic elements therein.

6. The cutting device according to claim 3, wherein the second section comprises a power source for the cutting device housed therein.

7. The cutting device according to claim 3, wherein the second section is coupled to the first section at an angle.

8. The cutting device according to claim 3, wherein the first section comprises a surface configured to reduce reflections of said signals.

9. The cutting device according to claim 1, wherein at least one of the at least one sensor is mounted on a support structure extending from the body, the support structure including a contoured attachment to facilitate smooth flow of hair around the support structure.

10. The cutting device according to claim 9, wherein the support structure comprises a mounting post which extends axially away from the body.

11. The cutting device according to claim 9, wherein the support structures are adjustably coupled onto the body.

12. The cutting device according to claim 1, wherein the at least one sensor is positioned on the body such that a hand may grasp the body for manipulation of the cutting device without obstructing the at least one sensor.

13. The cutting device according to claim 1, wherein the signals comprise at least one of electrical signals, magnetic signals, electromagnetic signals, sounds signals, acoustic signals, ultrasonic signals, optical signals, optical image signals, camera images, video signals, light signals, infrared light signals, ultraviolet light signals, visible light signals, structured light signals, radar signals, sonar signals, or lidar signals.

14. An automated hair cutting system for cutting hair on a user's head comprising:

a positioning apparatus including a support apparatus for supporting the positioning apparatus, the positioning apparatus having at least one positioning interface positioned on the support apparatus;

a cutting device, the cutting device comprising:

a body;

a cutter head attached to the body, the cutter head configured for manipulating and cutting hair; and at least one sensor coupled to the body, the at least one sensor configured to either send signals to or receive signals from the at least one positioning interface, the signals employable to at least partially determine a plurality of distances between the cutter head and the user's head including locations of varying distances from a surface of the user's head as said cutting device is articulated about said user's head;

the cutting device is configured to employ a plurality of cutting actions by said cutter head that are initiated by said automated hair cutting system, said cutting actions employable to cut hair to a plurality of lengths, each of said plurality of cutting actions initiated at least partially responsive to the distances between the cutter head and the user's head.

15. The automated hair cutting system according to claim 14, wherein the body comprises at least a first section and a second section, wherein the cutter head is coupled to the first section and the second section comprises a handle.

16. The automated hair cutting system according to claim 15, wherein the first section comprises at least an actuating member, wherein the actuating member comprises mechanical elements configured to drive the cutter head.

17. The automated hair cutting system according to claim 15, wherein the second section comprises a power source for the cutting device housed therewithin.

18. The automated hair cutting system according to claim 14, wherein at least one of the at least one sensor is mounted on a support structure extending from the body, the support structure including a contoured attachment to facilitate smooth flow of hair around the support structure.

19. The automated hair cutting system according to claim 18, wherein the support structure comprises a mounting post which extends axially away from the body.

20. The automated hair cutting system according to claim 14, wherein the signals comprise at least one of electrical signals, magnetic signals, electromagnetic signals, sounds signals, acoustic signals, ultrasonic signals, optical signals, optical image signals, camera images, video signals, light signals, infrared light signals, ultraviolet light signals, visible light signals, structured light signals, radar signals, sonar signals, or lidar signals.

* * * * *